US006203482B1

(12) United States Patent
Sandford

(10) Patent No.: US 6,203,482 B1
(45) Date of Patent: Mar. 20, 2001

(54) CUTTING, SCORING AND PERFORATING DIE SET AND METHOD

(76) Inventor: Peter Nmi Sandford, 176 Stronach Crescent, London, Ontario (CA), N5V 3A1

( * ) Notice: Subject to any disclaimer, the term of this patent is extended or adjusted under 35 U.S.C. 154(b) by 0 days.

(21) Appl. No.: 09/208,442

(22) Filed: Dec. 10, 1998

(30) Foreign Application Priority Data

Sep. 29, 1998 (CA) ..... 2248840

(51) Int. Cl.[7] ..... B31B 1/25

(52) U.S. Cl. ..... 493/61; 63/355; 63/363; 63/366

(58) Field of Search ..... 493/372, 366, 493/364, 363, 355, 354, 59, 61, 63, 73, 160

(56) References Cited

U.S. PATENT DOCUMENTS

| | | | | |
|---|---|---|---|---|
| 2,195,819 | | 4/1940 | Kurtzeborn | 83/142 |
| 2,313,801 | | 3/1943 | Carll | 83/691 |
| 2,390,072 | | 12/1945 | Beaton | 83/51 |
| 2,821,871 | | 2/1958 | Sarno | 76/107.8 |
| 2,860,555 | | 11/1958 | Williamson | 493/476 |
| 2,939,358 | | 6/1960 | Pearson | 83/641 |
| 3,020,809 | | 2/1962 | Guyer et al. | 493/354 |
| 3,142,233 | | 7/1964 | Downie | 493/354 |
| 3,170,342 | | 2/1965 | Downie | 76/107.8 |
| 3,292,513 | | 12/1966 | Palmer | 493/354 |
| 3,485,146 | | 12/1969 | Sarka | 493/354 |
| 3,786,732 | | 1/1974 | Forbes, Jr. | 493/354 |
| 3,869,949 | | 3/1975 | Dolle | 83/320 |
| 3,929,059 | | 12/1975 | Gendron | 493/363 |
| 3,982,458 | | 9/1976 | Terasaka | 83/685 |
| 5,021,042 | * | 6/1991 | Resnick et al. | 493/59 |
| 5,140,872 | | 8/1992 | Holliday et al. | 76/107.8 |
| 5,156,584 | * | 10/1992 | Cohen et al. | 493/59 |
| 5,163,894 | * | 11/1992 | Ogawa | 493/59 |
| 5,370,028 | * | 12/1994 | Grebe | 493/61 |
| 5,943,935 | * | 8/1999 | Brayton et al. | 493/61 |
| 5,983,765 | | 11/1999 | Sandford | 83/641 |

* cited by examiner

*Primary Examiner*—Brian L. Johnson
*Assistant Examiner*—Matthew Luby
(74) *Attorney, Agent, or Firm*—Birch, Stewart, Kolasch & Birch, LLP

(57) ABSTRACT

An apparatus for substantially-simultaneously die cutting cardboard sheets for forming folded cardboard cartons and an openable and closable tab. The improvement resides in a die set comprising a plurality of cutting knives projecting from a base, the cutting knives being fixed into a preselected pattern of grooves within the base. The die set may further include at least one transversely-spaced-apart pair of a die blade and a perforating knife mounted in the base, in which either or both of the die blade or the perforating knife is "jackably mounted" for selective manual raising or lowering. The die set may alternatively further include at least one transversely-spaced-apart pair of a die blade and an anvil mounted in the base, in which either or both of the die blade or the anvil is "jackably mounted" for selective manual raising or lowering. In either case, the base is secured to a back-up plate. Either die set is used in a double platen die cutting apparatus in which the die set is mounted on the upper platen and in which the lower platen is movable towards the upper platen. The perforating knife may still further alternatively be mounted on the lower platen. In all cases, the die blade and the perforating knife converge to a common focal or starting point when the platens are urged towards one another with the cardboard therebetween, to provide for a common starting point for the operable and closable tab.

4 Claims, 10 Drawing Sheets

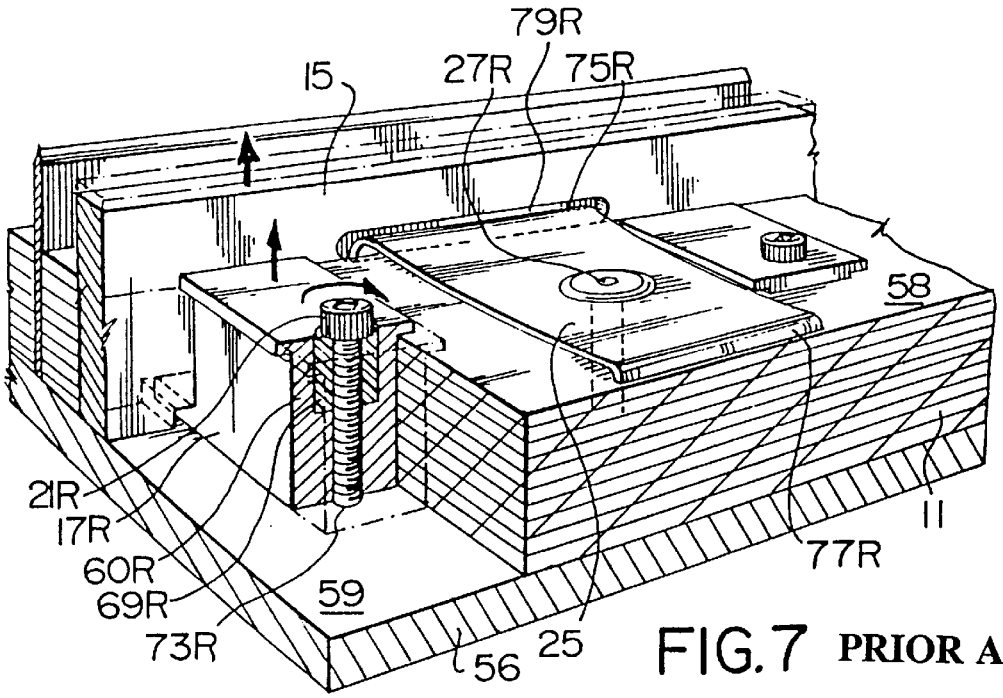
FIG. 7 PRIOR ART
PRIOR ART
FIG. 8
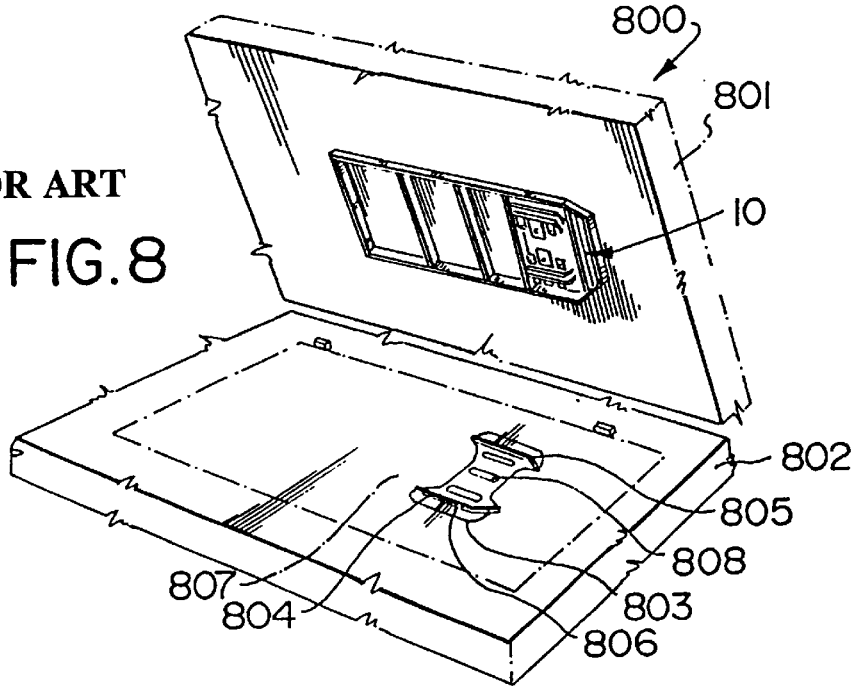

CUTTING, SCORING AND PERFORATING DIE SET AND METHOD

BACKGROUND OF THE INVENTION RELATES (a) Field of the Invention

This invention relates to dies for, and a method of, forming folded cardboard cartons, which also include package-opening features in the nature of tear strips.

(b) Description of the Prior Art

Methods and apparatus are now known for die cutting cardboard. In addition, tear strips have been produced in such cardboard cartons by die cutting the cardboard from opposite sides thereof to provide removable areas which are defined by relatively widely spaced-apart creases extending into one surface of the cardboard and more closely spaced-apart creases extending in parallel side-by-side relation to the first creases and extending into the opposite side of the cardboard. When the intermediate area was grasped, the cardboard split from one cut crease to the other to permit removal of the defined area. Under normal circumstances, this die-cutting operation was done by first die cutting one side of the cardboard and then die cutting the opposite side of the cardboard in a separate operation. This method had been carried out using cutting presses which were normally provided with a die which was engageable with one side only of the cardboard.

Steel rule dies for cutting and scoring as well as embossing sheets of cardboard have been fabricated from wood, laminated wood, resinated and impregnated woods, in which the steel rule cutting knives and scoring rules had been fitted into slots which were cut into the die body of the wood or metal and which were held in position by various means, including the introduction of plastic materials, e.g., epoxy resins, into slots or cavernous openings in the die base to anchor securely the cutting rules and scoring rules from displacement. The rule-retaining means had been time consuming to fabricate and costly to build. The life of steel rule dies that had been encavitated for supporting the steel rules by introducing plastic materials to support the rules in a solid base material have not been commercially successful.

Reusable counterplates for cutting and scoring boxboard or paperboard to form carton blanks must be accurately constructed for reuse on hundreds of thousands or millions of impressions and cuttings, thereby necessitating precision fabrication and highly durable materials for providing cutting and scoring dies for retaining the cutting and scoring plates or rules in position in their slots within the base or supporting die member. Such cutting and scoring dies included cutting knives defining the outline of the blank as well as the location of other cuts through the cardboard, and scoring rules which weakened the cardboard in preparation of subsequent folding operations.

Cutting knives and scoring rules are flat or bent strips of sheet steel, which were provided either with a sharp cutting edge or with a rounded scoring edge, depending on their respective use, and were manufactured by several alternative procedures. According to one conventional manufacturing procedure, the cutting knives and the scoring rules of a die were assembled in upright position, with the cutting edge or the scoring edge pointing upward, the spaces between the various knives and rules being filled by blocks. A conventional cutting and scoring die was laid out by selecting available such assembled dies having the desired dimensions, placing the knives and rules thereon and then tightening the entire assembly by wedges, or otherwise, within a surrounding frame or chase. The above outlined procedure made the accuracy of the box blanks dependent on the skill and the care of the diemaker.

According to another conventional manufacturing procedure, slots were cut into a large block or panel of wood and the knives and rules were placed in these slots. This construction made it necessary to discard the entire die when a major dimension of the box, e.g., length, width or height, was changed.

According to yet another conventional manufacturing procedure, a rule die set had a base on which a male die was rigidly mounted. A female die was provided on a ram and was cooperative with the male die on each working stroke of the ram to blank a piece from cardboard. The female die was in the form of a rule which was embedded in plywood which engaged and held the rule along its side walls. The upper end of the rule abutted against the bottom of the ram directly to receive the working force, the wood blocks being used for a die supporting function. The lower or cutting edge of the rule projected downwardly and beyond the bottom surface of the wood. Within the rule and in the space between the inside wall of the rule and between the surface of the wood and the cutting edge of the rule, was a stripping element, usually a resilient elastomer material, e.g., hard rubber. With each working stroke of the ram, the rubber was compressed between the metal work piece and the surface of the wood as the rule passed through the cardboard. When the ram extracted, the rubber expanded and such expansion served to strip the blanked cardboard piece from the rule.

With such construction, providing sufficient stripping force involved problems. If a large piece of stripping rubber was employed which completely filled the space inside the rule, the compression forces of the confined rubber were directed not only to the surface of the wood but also against the inside wall of the rule. The lateral forces against the rule were transmitted to the wood and tended to rupture it. Further, each time the rubber expanded to strip the blanked piece, there were forces directed against the rule tending to pull it outwardly of the ram and the supporting blocks. If the wood was ruptured and the rule became loose, the die structure was rendered inoperable and had to be reconstructed.

According to a still further manufacturing procedure, the outline of the carton was laid out upon a board, e.g., plywood. The outlines were then cut with a jig saw, the width of the saw cut being equal to the thickness of the steel cutting band, whereupon the cutting bands,which were shaped to conform with the outlines of the carton, were forced into the saw kerfs provided therefor. Thus, each cutting band or individual die member was permanently fixed in the base board or supporting member in accordance with the position of the carton. Any slight error of the diemaker in positioning one of the die members with relation to the others was difficult to correct.

Several expedients have heretofore been used to correct lack of positioning. One of such expedients comprised cutting out an entire die member from the integral block and then providing shims in the saw cuts to move the defectively registered die into proper registration. This method entailed a great deal of labour and increased the cost of the die.

Another expedient formerly employed was to bend the extended portion of the cutting bank slightly into conformity with the outline of the carton. This latter expedient required the die steel to be untempered to enable the cutting bands to be bent. The life of the die was relatively short.

In other words, such die sets have been made by setting steel rules for cutting the cardboard in a predetermined pattern between individually cut wood blocks, which were held in a steel frame by wooden wedges with the edges of the rules extending above the blocks. Small blocks of sponge rubber, or synthetic cork, were generally placed on each side of the cutting rule to push the board free of the knives on completion of the cutting stroke. The scoring rules, in most systems, were glued to the wooden blocks. Other systems of dies were known in which the steel rules were inserted into grooves cut by jig saw into a slab of plywood of, e.g., ¾ inch thickness in a predetermined pattern so that when the plywood die was brought to bear against the cardboard, a blank of the desired configuration was stamped out.

In the formation of tear strips of the type employing a peripheral pair of die cut grooves in opposite sides of the cardboard, it was usual practice to have the die cuts or grooves extend approximately one-half of the thickness of the cardboard from either side thereof.

Patents now exist which are directed to dies for the cutting and scoring of sheet material. Canadian Patent No. 198,546, patented Mar. 23, 1920, by P. C. Simmons, provided a blank cutting machine. In this patent, the sheet was supported above the cutting die, and the cutting block was reciprocated vertically with respect to the cutting die. The cutting die was mounted on a stationary bed, and was adjustably mounted on a carrier by means of a series of set screws. There was no suggestion of relative adjustable movement between the cutting die and the cutting block. There was also no suggestion of the simultaneous formation of perforation lines along with the formation of the score lines.

Canadian Patent No. 430,490, patented Oct. 9, 1998, by G. F. Wales, provided a method and apparatus for perforating sheet material with a plurality of unconnected through holes. The perforating apparatus was for use in a press having a stationary bed and a ram which was movable toward and away from the bed. The apparatus included a pair of flat plates which were spaced apart and which were held in fixed relation to each other and which had holes therein. Die units were holes of one of the plates, and punch units, each consisting of a stripper and central punch through it, were arranged in the holes of the other plate. Each punch unit was in axial alinement with a die unit. One of the groups of units was movable by the ram of the press bodily relatively to its plate using its holes in its plate as guides toward the units on the other plate to perforate work placed between the plates. There was no teaching of relative adjustable movement between the flat pair of plates and the female steel rule. The was also no teaching of the simultaneous formation of cut-scores along with the formation of the perforations.

Canadian Patent No. 448,699, patented May 23, 1948, provided die sets for cutting-out articles from sheets of tough material. Such die set included the combination of a die member and a punch member. The die member included a flat base with a slot in its surface of a shape corresponding with the shape of the finished article. The portion of the base inside the slot was recessed, and a steel rule was held in the slot. Resilient pads were secured in the recessed portion of the base. A second steel rule was provided which bounded an area within the die outline and which corresponded with the position and shape of a desired aperture in the finished article. The punch member included a flat base with a slot in its surface of a shape corresponding with the contour of the finished article, the portion of the base outside the slot being recessed A third steel rule was held in that slot. Resilient pads were secured in the recessed portion of the base. A fourth steel rule was provided within the punch outline and corresponded with the second rule of the die member. There was no suggestion or teaching of relative adjustability of the steel rules.

Canadian Patent No. 462,244, patented Jan. 3, 1950, by C. A. Fourness et al, provided a method and apparatus for severing portions of a web of material. The apparatus included a pair of shearing blades which was mounted for relative movement to cause mutually-adjacent edges of the blades to approach and pass each other in material shearing relationship to each other. Means were provided for effecting such relative movement of the blades. One of the blades had a shearing edge which was serrated and was bevelled so as to provide a knife-like edge which cooperated with the other blade, the serrated edge being operative to pierce the web to be severed without removing material therefrom, whereby a plane of severance was produced. The apparatus included further means for gradually joining all of the spaced points of severance to form a plane of severance which extended through the web. There was, however, no teaching of relative adjustable movement between the pair of shearing blades. There was also no teaching of the simultaneous formation of cut-scores along with the formation of the piercing of the web.

Canadian Patent No. 710,631, patented Jun. 1, 1965, by T. Coy, provided a die structure. In that patent, the bed had a plateau which supported a male die having a peripheral shearing edge. The female die comprised a steel rule which was supported by a wood blank. On a downward stroke, the female steel rule blanked a shaped piece when the steel rule contacted the plateau. There was no teaching or suggestion of relative adjustable movement between the plateau and the female steel rule. There was also no teaching or suggestion of the simultaneous formation at perforations along with the formation of the shear lines.

Canadian Patent No. 1,312,542, patented Jan. 12, 1993, by J. V. W. Memmott et al., provided a method and apparatus for cutting sheets of material. In that patent, a cutting board was provided against which the cutting die cut the plies of sheets of material. The cutting die had a plurality of blades extending therefrom, the blades forming the perimeter of a ply. An ejector, which was comprised of foam rubber, was provided within the perimeter of the blades to detach each ply cut from a sheet of material by the die from within the perimeter of the cutting die after the blades of the die have cut the ply. Holding means depended from the blades outside the perimeter thereof to hold the skeleton of the material after cutting so that a complete and proper cut may be verified by separating the cut plies from the skeleton after the cut had been made. A cutting board was also provided against which the cutting die cut the plies, the cutting board having a plurality of stakes extending therefrom to register the cut plies thereupon. There was no teaching or suggestion of relative adjustable movement between the cutting die and the cutting board. There was also no teaching or suggestion of the simultaneous formation at perforations along with the formation of the shear lines.

U.S. Pat. No. 2,195,819, patented Apr. 2, 1940, by F. G. Kurtzeborn, provided a trimming and perforating die. Such die included a sliding plate which was adapted to be placed in a press. A stop was provided on the plate for gauging the movement thereof in the press. A plurality of upward projections was fixed to the plate. A removable base having a plurality of seats formed on its underside was provided for receiving the projections and for detachably holding the base on the plate. A resilient work support was secured to the upper face of the base. A die element was fixed in the base and had its upper end terminating adjacent to the upper face of the resilient work support and having its lower end flush with the underside of the base and bearing against the sliding plate. In that way, it was alleged that the plate formed a rigid wear-resistant backing for the die element. There was no teaching or suggestion of relative adjustability of the steel rules. There was also no teaching or suggestion of the simultaneous formation of perforations along with the formation of the score lines.

U.S. Pat. No. 2,313,801, patented Mar. 16, 1943, by K. W. Corll, provided a cutting die, which included a base member with a plurality of individual cutting members which were mounted on one surface of the base member, each of the cutting members including a supporting block which was provided with an endless saw kerf extending entirely through the block to provide an inner cut out portion and an outer portion. A thin metallic cutting blade was positioned in the saw kerf between the inner cut out portion and the outer portion and was gripped between these portions. The cutting blade had its base portion bearing against the surface of the base member and had a sharpened edge extending beyond the supporting block to form a closed cutting element. The cutting members were each mounted on the base member for limited movement along the surface of the base member. Means were provided for rigidly securing the cutting members in registered position to the base member. While it was alleged that such individual die members of the multiple die were mounted and arranged so as to be capable of being moved with relation to each other and with relation to their common support there was, however, no suggestion or teaching of relative adjustability of the height of the steel rules. There was also no suggestion or teaching of the simultaneous formation of perforation lines along with the formation of the score lines.

U.S. Pat. No. 2,390,072, patented Dec. 4, 1945, by Robert G. Beaton, provided a method of producing a potential opening in a fibre container. Such method included subjecting a localized area of the wall section to high pressure to compress and compact the material within the localized area. This was alleged to break down and displace the fibrous structure of the material into a weakened reduced thickness area of hard brittle substance capable of disintegrating into a granular condition when punctured. This was therefore alleged to provide an opening having a clean cut edge in the wall section of the article. Since no steel rules were disclosed, there was no suggestion or teaching of relative adjustability of steel rules. There was also no suggestion of the simultaneous formation of perforation lines along with the formation of the score lines.

U.S. Pat. No. 2,821,871, patented Feb. 4, 1958, by A. J. Sarno, provided a method of producing die members which included shear blades and retaining means. Such method included making a cut along the full outline of a closed figure in a base member, of a width which was equal to the combined thickness of the blades and the retaining means to define a section within the outline of the same shape. Shear blades were mounted in the cut, which were spaced from the section and which projected along one edge from the member. Retaining means were disposed between the blades and the section to secure the blades in place. A similar cut was made along a matching outline in another base member, to define a similar section in the other base member. Other shear blades were mounted in the other base member projecting along one edge therefrom, and in contact with the similar section. Still other retaining means were disposed between the other blades and the edges of the similar cut, in such position so that the first named blades closely enveloped the second named blades when the blades of the members were in engagement with each other. There was no suggestion or teaching of relative adjustability of the height of the steel rules. There was also no suggestion or teaching of the simultaneous formation of perforation lines along with the formation of the score lines.

U.S. Pat. No. 2,860,555, patented Nov. 18, 1955, by M. I. Williamson, provided cutting and scoring dies, which included a plurality of spaced blocks, there being at least one block for each corner of the box blank. The blocks had vertical slots therein which were adapted to receive cutting knives and creasing rules. Certain portions of the slots extended entirely through the blocks. The slots were interrupted at other portions, so as to leave connecting bridges between the portions of the block on both sides of the respective slot. The die also included a first set of internal cutting knives and creasing rules provided in the blocks, the knives and creasing rules of the first set terminating short of the boundaries of the respective block and representing a standardized configuration of the corners of the box blank. A second set of interconnecting cutting knives and scoring rules was also provided which abutted the ends of the internal knives and scoring rules and extended from one block to another, the second set of knives and rules being replaceable by others of different lengths to produce a series of blanks of different main panel size. The second set of knives and scoring rules had notches extending into the external knives and rules from the bottom edge and adjacent the ends. The notches fitted the bridges, thereby locking the blocks together at predetermined distances. The cutting knives and scoring rules were taller than the blocks to protrude above the top surfaces of the blocks when the bottom edges of the knives and rules were flush with the bottom surfaces of the blocks. There was no suggestion or teaching of relative adjustability of height of the steel rules. There was also no suggestion or teaching of the simultaneous formation of perforation lines along with the formation of the score lines.

U.S. Pat. No. 2,939,358, patented Jun. 7, 1960, by E. W. Pearson, provided a ledger blade adjustment means for a shear machine. This patent taught a horizontal adjustment of a lower knife with respect to an upper knife, in order to adjust the clearance. This was brought about by adjustment of a table assembly which was accomplished by positioning, within the upper portion of each of the slots, a bearing block for altering the spacing between the abutment lug and the edge defined by the upper end of the slot. The bearing block was welded to the upper end of the abutment lug. A bearing pad engaged the upper edge of the slot in spaced relationship to the bearing block, with one or both opposing surfaces being angled slightly. A wedge was adapted to be driven between the bearing block and the bearing pad. Controlled movement of the wedge in making adjustments was necessary, as the movement at one end of the front wall must be duplicated at the other end with substantial accuracy. However, there was no suggestion of direct, infinitely-variable control of relative spacing of the anvil against which the die blade cooperated to provide a reverse score cut. There was no suggestion or teaching of relative adjustability of the height of the steel rules. There was also no suggestion or teaching of the simultaneous formation of perforation lines along with the formation of the shear lines.

U.S. Pat. No. 3,020,809, patented Feb. 13, 1962, by R. Guyer et al. (and its corresponding Canadian Patent No. 655,713, issued Jan. 8, 1963, to R. Guyer et al,), provided apparatus for die cutting and scoring cardboard which included a fixed platen having a metal die cutting plate thereon, the plate having a flat outer surface. A lower die was provided which included die cutting edges which projected from the cutting plate. A movable platen cooperated with the fixed platen, and a wooden base was supported by the movable platen, the wooden base including a die cutting rule projecting therefrom. Metal inserts were provided in the die, the metal inserts being supported upon the movable platen against which die cutting edges which projected through the die cutting plate may operate. These inserts were so arranged that the exposed surface of the inserts were spaced from the surface of the die cutting plate by a distance which was substantially equal to the thickness of the cardboard being cut. As a result, over the specific areas of the die in opposed relation to the die cutting edges on the fixed platen, an extremely accurate control of the depth of cut was alleged to be obtained. However, there was no teaching of an infinitely-variable control since the control steps were limited to the finite thickness of the metal inserts. There was also no suggestion or teaching of the simultaneous formation of perforation lines along with the formation of the score-lines.

U.S. Pat. No. 3,142,233, to Downie, issued Jul. 28, 1964, provided cutting and scoring dies, each of which included at least one severing land cooperable with a severing land of the other die plate to cut sheet-like material which was positioned therebetween. The die plates also included scoring lands in order to provide score lines on the sheet-like material. The cutting was effected by the lands which were formed on the die plates and which normally overlapped to a minor degree. A minor portion of a sheet-severing land on one of the die plates overlay a minor portion of a cooperating sheet-severing land on the other die plate to effect the severing of the material. There was no suggestion or teaching of relative adjustability of the height of the steel rules. There was also no suggestion or teaching of the simultaneous formation of perforation lines along with the formation of the score lines.

U.S. Pat. No. 3,170,342, patented Feb. 23, 1995, by R. H. Downee, provided a method of making cutting dies. A one-piece metallic plate had a photographically-registered representation of the male scoring and cutting elements in extremely shallow relief on its upper surface. The main surface of the plate was chemically etched away so that the scoring and cutting elements stood in slight relief. A complementary one-piece metallic female die was also provided which included cutting elements and scoring elements which co-acted with those of the male die to form the scores and cut lines of the finished carton blank. These elements were also photo-composed and in very shallow relief to the chemically-etched background surface of the metallic plate. The patentee taught that the vertical gap between the male and female die plates when the press was on impression was adjustable to a percentage of the over-all thickness of the board, to range from a slight overlap. Such vertical gap was adjusted by adhesively securing the male scoring die plate to a base of suitable thickness, or by attaching a thin sheet of resilient material to the etched background of the female plate by double sided adhesive tape. Thus, there was no teaching of an infinitely-variable control of such vertical gap, since the control steps were limited to the finite thickness of the securing member. There was no suggestion or teaching of the simultaneous formation of perforation lines along with the formation of the score lines.

U.S. Pat. No. 3,292,513, patented Dec. 20, 1966, by C. E. Palmer, provided apparatus for scoring sheet material, including a die assembly which included a rectangular frame within which scoring members and cutting blades were received, which were held in predetermined spaced-apart relationship by wooden spacer elements. The frame assembly included scoring platen members and a cutting platen member. The scoring platen members were resiliently supported by the resilient support member and the cutting platen member was independently and rigidly supported by the metal blocks. Thus, while a depth control was provided, such depth control was by way of resilient supporting means. There was no suggestion or teaching of an infinitely-variable control of the depth. There was also no suggestion of the simultaneous formation of perforation lines along with the formation of the score lines.

U.S. Pat. No. 3,485,146, patented Dec. 23, 1969, by A. J. Sarka, provided cutting or scoring dies, which included a pair of die plates, each of which included at least one severing element. The severing elements on the die plates were cooperable to cut sheet-like material which was positioned therebetween. The severing elements on the die plates were mirror images of each other, and were in the form of narrow blades projecting above the main surface of the respective die plates. The blades had a substantially aligned relationship when operating to effect the severing of material positioned therebetween. The die plates also included scoring elements thereon. There was no suggestion or teaching of relative adjustability of height of the steel rules. There was also no suggestion of the simultaneous formation of perforation lines along with the formation of the score lines.

U.S. Pat. No. 3,786,732, patented Jan. 22, 1974, by H. E. Forbes, Jr., provided a cutting and scoring die, which was specially designed for simultaneously cutting and scoring the inside surface of sheet-like material in order to form blanks having uninterrupted exterior surfaces. The die had both cutting and scoring elements which were fixedly mounted thereon. The cutting elements included single sharpened cutting knives that extended beyond the surface of the die plate a distance which was sufficient to effect complete severance of the sheet-like material. The scoring elements included paired, parallel and sharpened scoring knives. The paired scoring knives were separated from one another by a distance which was only slightly greater than the thickness of the sheet-like material being cut and scored and extended beyond the surface of the die plate by a distance which was sufficient to produce score lines in the sheet-like material in the form of parallel cut lines which penetrated the sheet-like material sufficiently to rupture the uppermost surface thereof. There was no suggestion or teaching of the relative adjustability of the scoring elements. There was also no suggestion of the simultaneous formation of perforation lines along with the formation of the score lines.

U.S. Pat. No. 3,869,949, patented Mar. 11, 1975, by D. E. Dolle, provided a shear apparatus with blade holding means. The apparatus included an upper platen having an upper supporting member mounted thereon, and a lower platen having a lower supporting member mounted therein in vertical alignment with the upper supporting member. Means were provided for causing relative vertical movement of the platens toward and away from each other. A removable elongated top blade holder and top blade were rigidly mounted on the upper supporting member. Spaced shoulders were provided in the upper portion of the lower supporting member having parallel side faces. A mounting member and a pair of elongated wedges were mounted in the space between the shoulders for sliding movement lengthwise toward one side of the machine. A removable elongated lower blade holder and lower blade rigidly were mounted on the mounting member, the wedges being mounted on opposite sides of the mounting member and having outer side surfaces slidably engaging the side faces of the shoulders and flat tapered inner side faces slidably engaging the side faces of the mounting member. The tapered side faces had the same amount of taper and were adapted to position the lower blade parallel to the top blade when the two wedges were forced against the mounting member and against the side faces of the shoulders. Releasable hold-down means were provided for clamping each wedge in its adjusted position. Releasable means were also provided for preventing sliding movement of the mounting member out of its adjusted position. The lower blade holder and lower blade were removable with the mounting member by sliding them lengthwise out of the side of the machine after the wedges were loosened. There was no suggestion or teaching of the relative adjustability of a scoring blade. There was also no suggestion or teaching of the simultaneous formation of perforation lines along with the formation of the score lines.

U.S. Pat. No. 3,929,059, patented Dec. 30, 1975, by W. P. Gendro, which provided a die counter plate. Such counter plate included a mounting plate that was detachably mountable on the press and at least one cutting plate which was adapted to cooperate with knives and scoring rules on a male die to form a carton blank. The cutting plates were releasably retained on the mounting plate. There was no suggestion or teaching of relative adjustability of scoring rules. There was also no suggestion or teaching of the simultaneous formation of perforation lines along with the formation of the score lines.

U.S. Pat. No. 3,982,458, patented Sep. 28, 1976, by T. Terasake, provided a die set, which included a first die holder which was movable towards and away from a second die holder which was spaced below the first die holder which was detachably fixed to a ram of a press machine by connector means. A first die was detachably secured to the first die holder. A second die having a setting plate was supported at both sides by means of opposed pairs of supports which were mounted on the second die holder so as to be movable up and down. Plural positioning pins were slidably inserted in the second die holder and were fittable into holes which were provided in the setting plate. Drive means were provided for elevating and lowering the supports and the positioning pins in a simultaneous manner, so that the supports move reversely to the positioning pins. A clamp means was provided for firmly holding the setting plate on the second die holder. There was no suggestion or teaching of the relative adjustability of the scoring elements. There was also no suggestion or teaching of the simultaneous formation of perforation lines along with the formation of the score lines.

U.S. Pat. No. 5,140,872, patented Aug. 25, 1992, by G. L. Holliday et al., provided a steel rule die. Such steel rule die included the combination of a steel rule male cutting and scoring die and a female counter plate, including a male metal faceplate, the metal face plate having a series of laser beam cut steel rule elongated precision slots. Steel rule cutting and scoring members were securely retained in the laser beam cut elongated precision slots corresponding to a predetermined pattern of sheet material to be die cut and scored. A female counter plate was positioned and aligned to cooperate with the male metal face plate and steel rule cutting and scoring members, the female counter plate having a metal plate. The female metal counter plate had a series of laser beam cut elongated precision slots cooperatively to receive the steel rule edge scoring members which were retained on the male metal face plate. A counter back-up plate was secured to the female counter plate to blank the laser beam elongated slots for receiving the steel rule scoring members and sheet materials to be scored in the elongated slots in the female counter plate. There was no suggestion or teaching of relative adjustability of the steel rules. There was also no suggestion or teaching of the simultaneous formation of perforation lines along with the formation of the score lines.

Many other patents disclosed cartons which included reclosable closures which were made using apparatus similar to those in the above-identified patents. Among those patents are the following.

Canadian Patent No. 539,038 patented Apr. 2, 1957, by C. Merger-Jagenberg, provided a container with a rip-open flap in which the adhesive securing the rip-open flap to the container wall stretched beyond the edge of the aperture flap, which was cut in the wall of the container, in order firmly to apply the aperture flap again to the adjacent parts of the container wall by means of the rip-open flap lying above it, preventing an unintentional loosening of the aperture flap from the container wall. In addition, an area was left free of all adhesive on the rip-open flap, which area interrupted the adhesive coating and surrounded the cut edges of the aperture flap, in that place in which the discharge opening became free first of all when the rip-open flap was raised.

Canadian Patent No. 664,280, patented Jun. 4, 1963, to K. C. Etches, provided a carton which may be opened by tearing the extension from an adjacent side, the extension then forming a flap on the one side. The flap may be tucked in against the inner face of the adjacent side in temporary reclosing of the carton. The extension had at its extremity, a portion which was not secured to the adjacent side, so that the carton was openable by manually gripping the unsecured portion and tearing the extension from the adjacent side. The adjacent side was scored along its outer face to assist in separation of the extension from the adjacent side.

Canadian Patent No. 723,494, patented Dec. 14, 1965, by F. W. Schreiber et al, provided a reclosable carton which was formed from a single blank of paper board that had body panels which were fastened together and closed at the bottom. Top flaps extending from the body panels were cut, scored and perforated to provide a hinged closure for a pouring outlet for the carton. Weakened lines in the first and second flaps defined the pouring outlet for the carton. Another weakened line in the front panel defined a tab which, when torn therefrom, provided a finger hole. A flap extending from the roof of the carton overlay the tab to which it was accurately fastened by a suitable adhesive. The overlying flap was lightly secured to the front panel adjacent the tab. The flap could be grasped to tear the tab from the front panel and provided a finger hole, and the hinged closure ripped from the top of the carton which provided an opening through which the carton contents may be poured.

Canadian Patent No. 754,908, patented Mar. 21, 1967, by E. W. Scharre, provided a container which included a cover which was provided with pairs of cooperating score lines cut into but not through the cover in the plane of the closure portion. The major length of the score lines overlay the pan opening and at least one pair of score lines was cut into one of the flap portions to define a starting tab to permit ease of opening of the container. By providing the score lines as described, the container could be easily opened by simply tearing the cover portion. The container so-formed was a self-contained, easily-openable assembly.

Canadian Patent 836,926, patented May 17, 1976, by N. H. Moore et al provided a carton which was adapted to be fully sealed and expeditiously opened to dispense goods therefrom. The top closure included a first flap which was hingedly connected to a first side panel and a second flap of less width than the first flap which was hingedly connected to the second side panel. First cuts were formed on the second side panel at each corner of the top closure so that the second flap was hingedly connected to the second side panel. Second cuts were formed on an underside of the first flap. Each of the first and second cuts were arranged to extend into their respective panel or flap to a limited depth. Means adhesively secured inner surface portions on the first flap in overlying relationship with respect to the second flap adjacent to the second cut means for permitting the portions to remain secured to the second flap when the first flap was detached from the second flap. The first cut was detached from the second flap. The first cut was constructed and arranged to permit a slight crushing of the corner portions of the first and second flaps and the second side panel to effect efficient sealing thereat.

Canadian Patent No. 741,190, patented Aug. 23, 1966, by K. A. Smith, provided a reclosable carton in which the top wall and the front wall member had parallel laterally- spaced fracturing formations therein. A hinging score was provided in the top wall at the inner ends of the fracturing formations, thereby providing a hinge connection for the portion between the fracturing formations. That portion constituted a closure member. The adhesive for securing the top member front wall to the front wall of the body member was at the outer sides of the fracturing formations therein. The pour formations were spaced and were of such length as to provide a contents access opening in the top wall.

Canadian Patent No. 769,554, patented Oct. 17, 1967, by J. C. Hughes, provided a reclosable carton in which a cover was hingedly connected to the upper edge of its rear wall and included a top panel. A cover front wall was adapted to overlap the upper portion of the front wall. Means held the cover front wall in right angular relation to the top panel. One of the front walls included a locking flange which was connected to an edge thereof and which extended between the front walls. The locking flange had a slit therein through which the major portion of the length thereof parallel to the fold line connecting the locking flange to one front wall and was located intermediate the upper and lower edges of the flange. The slit terminated in spaced-apart relation to the end edges of the flange. Means secured the portion of the flange between the slit and the edge of the flange most remote from the line of fold connecting the flange to one front wall, the area of the flange between the slit and the line of fold connecting the flange to one front wall was free of engagement with the front wall, thereby providing a tendency for this area of the flange to bow away from the one side wall. An abutment flange was secured to the surface of the outer front wall in opposed relation to the secured area of the locking flange in closed condition of the cover. It had an edge providing a shoulder against which the edge of the slit on the unsecured area of the flange may engage.

Canadian Patent No. 988,477, patented May 4, 1976, by N. A. Brackmann, provided a container with a cover in which an openable closure element was formed integral with a sleeve and was defined by first and second laterally-spaced-apart scorings formed in the sleeve. Each of the scorings extended from one of the lateral side edges joining an end panel containing a tab outline across the top panel towards the other of the lateral side edges. At least a substantial length of one of the scorings extended adjacent and substantially parallel to one of the longitudinal side edges and at least a substantial length of the other of the scorings extended adjacent and substantially-parallel to the other of the longitudinal side edges. The scorings terminated one at each end of the second score line in one end panel containing the other tab outline and which was attached to the top panel at the other lateral side edge. Upon severing the second score line and pulling on the other tab, the openable closure element was detached from the remainder of the sleeve along the first and second scorings. The openable closure element was thereby hinged about one lateral side edge of the top panel.

Canadian Patent No. 1,037,003, patented Aug. 22, 1971, by A. Salomons, provided a cardboard box, which was provided with an outlet opening in a multilayered wall portion, This outlet opening was closed by a closing lip which can be swung open and reclosed and which was formed from a plurality of layers of box material that had been glued together. In such carton, the closing lip, having been opened, was clampingly reclosable due to the fact that this closing lip, when swung back to the reclosed position, was capable over the whole width of its free end of being pressed farther into the box than in the original closed position.

Canadian Patent No. 1,115,674, patented Jan. 5, 1982, by H. D. Johnson, provided an openable paperboard carton in which the tear-off portion of the carton included a pair of reverse cuts, which were positioned on the upper lid and which initiated, at an edge of one top side panel and ran to a central portion upper edge of an adjacent side panel, thereafter running on the top panel in juxtaposition to the adjacent side panel edge and terminating in the central portion of the top side panel opposite to the top side panel where the reverse cuts initiated. The reverse cuts were positioned to form triangular-shaped corner reinforcements on the upper lid located at each corner of the lid. The reverse cuts also formed an elongated section on two opposite sides of the carton, the two elongated sections being substantially-parallel to each other and connecting the triangular-shaped corner reinforcements.

Canadian Patent No. 1,202,252, patented Mar. 25, 1986, by M. W. Kuchenbecker, provided a carton with an opening structure, namely, an opening flap structure for the side wall of a relatively-flat paperboard carton. The patent provided a tear strip structure, wherein the side wall was defined by an inner folded closure flap and an outer closure flap folded thereover. The outer flap had a line of weakness extending along its length, between, and parallel to, its fold line and its free edge. The inner flap had a first cut score defining its fold line, and a second cut score along a line which was coincident with the line of weakness of the outer flap. The region of the outer flap overlying the region of the inner flap between the cut scores ones was adherent to the latter region and defined a tear strip. An end portion of the tear strip was non-adherent and functioned as a tap by which the strip may be grasped and torn away, thereby separating the plies of the underlying closure flap between the cut score lines in achievement of removal of the strip in a predictable, controlled manner.

Canadian Patent No. 1,297,052, patented Mar. 3, 1992, by S. M. Blackman, provided a reclosure device for a resealable container which included inner and outer panels which were disposed in overlapping relation with the inner panel defining a dispensing opening and the outer panel having formed therein a closure flap overlying on the dispensing opening. The outer panel had spaced side edges and the closure flap was positioned between the outer panel side edges in spaced relation to the side edges with the closure flap having side edges and ends. The side edges of the closure flap were defined by zig-zag lines of weakening which in the formation of the container maintained the closure flap integral with the outer panel until the container was initially opened. The inner panel was provided with cut lines underlying and being generally aligned with the zig-zag lines of weakening and the cut lines define on the inner panel shoulders behind which closure flap projections which resulted when the closure flap projections which resulted when the closure flap was separated from the remainder of the outer panel along the lines of weakening so as to engage to retain the closure flap in its dispensing opening closing position.

SUMMARY OF THE INVENTION (a) Aims of the Invention

In summary, therefore, in none of the patents disclosed above is there any suggestion or teaching that steel rules should, or could, be controllably and infinitely variably-vertically movable. There was also no suggestion or teaching of the simultaneous formation of perforation lines along with the formation of the score lines.

One object of the present invention is to provide a die including a cutting plate having steel rule blades and perforating knives which are disposed therein in a preselected orientation for the purpose of providing a cut-score, as well as providing a perforation cut.

Another object of this invention is to provide such die with an adjustable die blade, and/or an adjustable perforating knife.

Still another object of this invention is to provide an apparatus for the production of a tear strip in a cardboard carton by simultaneously cutting, scoring and perforating from the same side of the cardboard.

Yet another object of this invention is to provide an apparatus for the production of a tear strip in a cardboard carton by simultaneously cutting, scoring and perforating from opposite sides of the cardboard.

(b) Statements of Invention

By a first embodiment, the present invention provides an improvement in an apparatus for substantially-simultaneously die cutting cardboard sheets for forming folded cardboard cartons as well as an openable and closable tab, the improvement including a die set comprising a plurality of cutting knives projecting from a base, the cutting knives being set fixed into a preselected pattern of grooves within the base, the die set further including (i) at least one transversely-spaced-apart pair of a die blade and a perforating knife, the pair of a die blade and a perforating knife being mounted in the base, the die blade and the perforating knife converging at a common focal point or starting point to provide a starting point for the openable and closable tab, (ii) separate securing means securing the die blade and the perforating knife of the at least one transversely-spaced-apart pair of a die blade and a perforating knife to the base, (iii) manually-actuatable means for adjusting the separate securing means for selectively raising or lowering a selected die blade and/or a selected perforating knife of the at least one transversely-spaced-apart pair of a die blade and a perforating knife, and (iv) a back-up plate to which the base is secured.

By a second embodiment, the present invention provides an improvement in an apparatus for substantially-simultaneously die cutting cardboard sheets for forming folded cardboard cartons as well as an openable and closable tab, the improvement including a die set comprising a plurality of cutting knives projecting from a base, the cutting knives being set fixed into a preselected pattern of grooves within the base, the die set further including (i) at least one transversely-spaced-apart pair of a die blade and a perforating knife, the pair of a die blade and a perforating knife being mounted in the base, the die blade and the perforating knife converging at a common focal point or starting point to provide a starting point for the openable and closable tab, (ii) an anvil which is mounted in the base, (iii) separate securing means securing the die blade and the perforating knife of the at least one transversely-spaced-apart pair of a die blade and a perforating knife to the base, (iv) separate securing means securing the anvil to the base, (v) manually-actuatable means for adjusting the separate securing means for selectively raising or lowering a selected die blade and/or a selected perforating knife of the of the at least one transversely-spaced-apart pair of a die blade and a perforating knife, (vi) manually-actuatable means for adjusting the separate securing means for selectively raising or lowering the anvil; and (iv) a back-up plate to which the base is secured.

The present application provides an apparatus for substantially-simultaneously die cutting cardboard sheets for forming folded cardboard cartons having an openable and closable tab. Such apparatus includes a first, upper, platen, the first, upper platen having secured thereto a plurality of side-by-side mounted die sets, each such die set including a plurality of cutting knives which are secured within a main block, the cutting knives being fixed into a preselected pattern of grooves within the main block. The die set further includes at least one transversely-spaced-apart pair of a die blade and a perforating knife, each such pair of the die blade and the perforating knife being secured within the main block. In each pair of the die blade and the perforating knife, the die blade and the perforating knife are slanted vertically towards one another. Separate securing means secure each die blade and each perforating knife of the at least one transversely-spaced-apart pair of a die blade and a perforating knife to the main block. Manually-actuatable means selectively, separately individually and directly adjust the separate securing means for selectively, individually, positively and directly raising a selected one of each die blade and of each perforating knife of the at least one transversely-spaced-apart pair of a die blade and a perforating knife, and for selectively, individually, positively, and directly lowering a selected one of each die blade and of each perforating knife of the at least one transversely-spaced-apart pair of a die blade and a perforating knife. The main block is secured to a back-up plate. Such apparatus also includes a second, lower, platen, the second, lower, platen being cooperable with the first upper, platen by relative movement therebetween to die cut cardboard sheets which are disposed therebetween. When the first, upper, platen and the second, lower, platen are urged towards one another with the cardboard therebetween, the die blade and the perforating knife converge at a common focal point or starting point thereby providing a starting point for the openable and closable tab.

By a fourth embodiment, the present invention provides an apparatus for substantially-simultaneously die cutting cardboard sheets for forming folded cardboard cartons having an openable and closable tab, the apparatus comprising: (I) a first platen, the first platen having secured thereto a plurality of side-by-side mounted die sets, each die set including a plurality of cutting knives projecting from a base, the cutting knives being fixed into a preselected pattern of grooves within the base, the die set further including (i) at least one transversely-spaced-apart pair of a die blade and a perforating knife which is mounted in the base, the pair of a die blade and a perforating knife converging at a common focal point or starting point to provide a starting point for the openable and closable tab, (ii) an anvil which is mounted in the base, (iii) separate securing means securing the die blade and the perforating knife of the at least one transversely-spaced-apart pair of a die blade and a perforating knife to the base, (iv) separate securing means securing the anvil to the base, (v) manually-actuatable means for adjusting the separate securing means for selectively raising or lowering a selected die blade and/or a selected perforating knife of the at least one transversely-spaced-apart pair of a die blade and a perforating knife, (vi) manually-actuatable means for adjusting the separate securing means for selectively raising or lowering the anvil and (iv) a back-up plate to which the base is secured; and (II) a second platen, the second platen being cooperable with the first platen by relative movement therebetween to die cut cardboard sheets which are disposed therebetween, whereby, when the first platen and the second platen are urged towards one another with the cardboard therebetween, the die blade and the perforating knife converge at a common focal point or starting point to provide a starting point for an openable and closable tab.

By a fifth embodiment, the present invention provides an apparatus for substantially-simultaneously die cutting cardboard sheets for forming folded cardboard cartons and an openable and closable tab, the apparatus comprising: (I) a first platen, the first platen having secured thereto a plurality of side-by-side mounted die sets, each die set including a plurality of cutting knives projecting from a base, the cutting knives being fixed into a preselected pattern of grooves within the base, the die set further including (i) at least one transversely-spaced-apart pair of a die blade and an anvil which is mounted in the base, (ii) separate securing means securing the die blade and the anvil of the at least one transversely-spaced-apart pair of a die blade and an anvil to the base, (iii) manually-actuatable means for adjusting the separate securing means for selectively raising or lowering a selected die blade and/or a selected anvil of the at least one transversely-spaced-apart pair of a die blade and an anvil; and (iv) a back-up plate to which the base is secured; and (II) a second platen, the second platen having secured thereto a like plurality of side-by-side mounted die cutting plates, each die cutting plates including a spaced-apart pair of perforating knives thereon, the perforating knifes being outlined by a compressible rubber pad, and a spaced-apart pair of pseudo-anvils constituting means within the area which is defined by the openable and closable tab for providing a solid surface against which the die blades on the first platen co-operate, the second platen being cooperable with the first platen by relative movement therebetween to die cut cardboard sheets which are disposed therebetween, whereby, when the first platen and the second platen are urged towards one another with the cardboard therebetween, the die blade and the perforating knife approximately converge adjacent a common focal point or starting point to provide a starting point for an openable and closable tab.

By a sixth embodiment, the present invention provides a method for die cutting an openable and closable tab in a sheet of cardboard which is to be formed into a carton, the tab including an area which is bounded at least through most of its periphery by cut-score lines extending partially through the cardboard sheet and by perforations extending completely through the cardboard sheet from the same side as the cut-score lines, the cut-score lines and the perforation lines being in closely-spaced, side-by-side relation, and in which one of the lines is formed by cutting by means of a first die blade, and the other of the side-by-side lines is formed by cutting out a similar, somewhat larger, area by means of a cooperating perforating knife, the method comprising mutually urging the first die set, which is provided with the die blades and with the perforating knifes, and which is mounted on a first platen into proximity with a second platen, which has means within the area defined by the openable and closable tab for providing a solid surface against which the die blades cooperate, controlling the depth of cut of the die blades, and ensuring proper starting of the opening tear of the tab by arranging the die blades and the perforating knives to converge at one focal or starting point, when the two platens are in close proximity to one another with the cardboard therebetween.

By a seventh embodiment, the present invention provides a method for die cutting an openable and closable tab in a sheet of cardboard which is to be formed into a carton, the tab including an area which is bounded at least through most of its periphery by cut-score lines extending partially through the cardboard sheet and by perforations extending completely through the cardboard sheet from opposite sides thereof, the cut-score lines extending into one side of the cardboard sheet being laterally-spaced from the perforation lines which extend through the cardboard sheet from the opposite side and being in closely-spaced, side-by-side relation to, and in which one of the lines is formed by cutting by means of a first die blade on a die set and the other of the lines is formed by cutting out a similar, somewhat larger, area by means of a perforating knife which is mounted on a die cutting plate, the method comprising mutually urging a first die set, which is provided with jackable die blades and jackable anvils, and which is mounted on a first platen into close proximity with a second platen which is provided with the perforating knives which are outlined by resilient rubber pads, and with pseudo-anvils constituting means within the area defined by the openable and closable tab for providing a solid surface against which the die blades on the first platen cooperate, controlling the depth of cut of the die blades and the perforating knives, and ensuring proper starting of the opening tear of the tab by arranging the die blades and the perforating knives approximately to converge adjacent one focal or starting point when the first platen and the second platen are in close proximity to one another with the cardboard sheet therebetween.

(c) Other Features of the Invention

By one feature of the first and second embodiments of the invention, the securing means for the at least one die blade comprises at least one die blade block supporting the die blade, the die blade block being adjustably held to the base by a die blade block bolt, rotation of the die blade block bolt tending to raise or lower the die blade block, and a die blade spring plate, the die blade spring plate being threadedly-secured to the base by a central bolt, whereby the raising of the die blade is accomplished by raising the die blade block by rotating the die blade block bolt against the reaction of the die blade spring plate, and the lowering of the die blade is accomplished by rotating the die blade block bolt in an opposite direction, the reaction of the die blade spring plate urging the die blade downwardly, so that the die blade spring plate substantially-continuously holds the die blade to the base. By one specific feature of that feature, the central bolt is threadedly-secured to the base plate, and the die blade block bolt is threadedly-secured within, and extends through, the die blade block, whereby the die blade block is raised or lowered upon appropriate rotation of the die blade block bolt, by reaction of an end of the die blade bolt against the back-up plate. By a second specific feature of that feature, and of the first specific feature thereof, the die blade spring plate is secured to the die blade by an indent which is punched out of the die blade, upon which an edge of the die blade spring plate rests.

By another feature of the first and second embodiments of the invention, and of the above-described features, the securing means for the at least one perforating knife comprises at least one perforating knife block supporting the perforating knife, the perforating knife block being adjustably held to the base by a perforating knife block bolt, rotation of the perforating knife block bolt tending to raise or lower the die blade block, and a perforating knife spring plate, the perforating knife spring plate being threadedly-secured to the base by a central bolt, whereby the raising of the perforating knife is accomplished by raising the perforating knife block by rotating the perforating knife block bolt against the reaction of the perforating knife spring plate, and the lowering of the perforating knife is accomplished by rotating the perforating knife block bolt in an opposite direction, the reaction of the perforating knife spring plate urging the perforating knife downwardly, so that the perforating knife spring plate substantially continuously holds the perforating knife to the base. By one specific feature of that feature, the central bolt is threadedly-secured to the base plate, and the perforating knife bolt is threadedly-secured within, and extends through, the perforating knife block, whereby the perforating knife block is raised or lowered upon appropriate rotation of the perforating knife block bolt, by reaction of an end of the perforating knife against the back-up plate. By a second specific feature of that feature variation and of these other features, the perforating knife spring plate is secured to the perforating knife by an indent which is punched out of the die blade, upon which an edge of the perforating knife plate rests.

By yet another feature of the first and second embodiments of the invention, and of the above-described features, the securing means for the anvil comprises at least one anvil block supporting the anvil, the anvil block being adjustably held to the base by an anvil block bolt, rotation of the anvil block bolt tending to raise or lower the anvil block, and an anvil spring plate, the anvil spring plate being threadedly-secured to the base by a central bolt, whereby the raising of the anvil is accomplished by raising the anvil block by rotating the anvil block bolt against the reaction of the anvil spring plate, and the lowering of the anvil is accomplished by rotating the anvil block bolt in an opposite direction, the reaction of the anvil spring plate urging the anvil downwardly, so that the anvil spring plate substantially continuously holds the anvil to the base. By one specific feature of that feature, the central bolt is threadedly-secured to the base plate, and the anvil bolt is threadedly-secured within, and extends through, the anvil block, whereby the anvil block is raised or lowered upon appropriate rotation of the anvil block bolt, by reaction of an end of the anvil against the back-up plate. By a second specific feature of that feature and of these other features, the anvil spring plate is secured to the anvil by a slot in the anvil, within which an edge of the anvil plate is disposed.

By still another feature of the first and second embodiments of the invention, and of above-described features, the support for the die blade and/or for the perforating knife and/or for the anvil comprises a respective lower step on a respective die blade and/or a respective perforating knife and/or a respective anvil, the lower edge of a respective die blade and/or respective perforating knife, and/or respective anvil resting on the respective step.

By yet still another feature of the first and second embodiments of the invention, and of the variants and variations thereof, the die set includes two longitudinally-spaced-apart die blade blocks and/or two longitudinally-spaced-apart perforating knife blocks supporting a respective die blade and/or a respective perforating knife.

By yet still a further feature of the first and second embodiments of the invention, and of the above-described features, the die set includes two longitudinally-spaced-apart die blade blocks supporting the die blades.

By still yet a further feature of the first and second embodiments of the invention, and of the above-described features, each securing means for the die blade comprises: an associated die blade block supporting each associated die blade, each associated die blade block being adjustably held to the base plate by an associated die blade block bolt, rotation of each associated die blade block bolt tending to raise or lower an associated die blade block, and an associated die blade spring plate, each associated die blade spring plate being threadedly-secured to the base plate by an associated central bolt, whereby the raising of the associated die blade is accomplished by rotating an associated die blade block bolt against the reaction of an associated die blade spring plate, and the lowering of the die blade is accomplished by rotating the associated die blade block bolt in an opposite direction, the reaction of each associated die blade spring plate urging the associated die blade downwardly, so that each associated die blade spring plate substantially-continuously holds the associated die blade to the base, and each securing means for the perforating knife comprises an associated perforating knife block supporting each associated perforating knife, each associated perforating knife block being adjustably held to the base plate by an associated perforating knife block bolt, rotation of each associated perforating knife block bolt tending to raise or lower an associated perforating knife block, and an associated perforating knife spring plate, each associated perforating knife spring plate being threadedly-secured to the base plate by an associated central bolt, whereby the raising of the associated perforating knife is accomplished by rotating an associated perforating knife block bolt against the reaction of an associated perforating knife spring plate, and the lowering of the associated perforating knife is accomplished by rotating the associated perforating knife block bolt in an opposite direction, the reaction of each associated perforating knife spring plate urging the associated perforating knife downwardly, so that each associated perforating knife spring plate substantially-continuously holds the associated perforating knife to the base.

By yet a further feature of the first and second embodiments of the invention, and of the above-described features, each securing means for the associated die blade comprises an associated die blade block supporting each associated die blade, each associated die blade block being adjustably held to the base plate by an associated die blade block bolt, rotation of each associated die blade block bolt tending to raise or lower an associated die blade block, and an associated die blade spring plate, each associated die blade spring plate being threadedly-secured to the base plate by an associated central bolt, whereby the raising of the die blade is accomplished by rotating an associated die blade block bolt against the reaction of an associated die blade spring plate, and the lowering of the associated die blade is accomplished by rotating an associated die blade block bolt in an opposite direction, the reaction of each associated die blade spring plate urging an associated die blade downwardly, so that each associated die blade spring plate substantially-continuously holds the associated die blade to the base, each securing means for the associated perforating knife comprises an associated perforating knife block supporting each associated perforating knife, each associated perforating knife block being adjustably held to the base plate by an associated perforating knife block bolt, rotation of each associated perforating knife block bolt tending to raise or lower an associated perforating knife block and an associated perforating knife spring plate, each associated perforating knife spring plate being threadedly-secured to the base plate by an associated central bolt, whereby the raising of the associated perforating knife is accomplished by rotating an associated perforating knife block bolt against the reaction of an associated perforating knife spring plate, and the lowering of the associated perforating knife is accomplished by rotating the associated perforating knife block bolt in an opposite direction, the reaction of each associated perforating knife spring plate urging the associated perforating knife downwardly, so that each associated perforating knife spring plate substantially-continuously holds the associated perforating knife to the base, and each securing means for the associated anvil comprises an associated anvil block supporting each associated anvil, each associated anvil block being adjustably held to the base plate by an associated anvil block bolt, rotation of each associated anvil block bolt tending to raise or lower an associated anvil block and an associated anvil spring plate, each associated anvil spring plate being threadedly-secured to the base plate by an associated central bolt, whereby the raising of the associated anvil is accomplished by rotating the associated anvil block bolt against the reaction of an associated the anvil spring plate, and the lowering of the anvil being accomplished by rotating the associated anvil block bolt in an opposite direction, the reaction of each associated anvil spring plate urging an the anvil downwardly, so that each associated anvil spring plate substantially-continuously holds the anvil to the base. By one specific feature of that feature, the die set includes two longitudinally-spaced-apart die blade blocks and two longitudinally-spaced-apart perforating knife blocks supporting a respective die blade and a respective perforating knife and the central bolt is threadedly-secured to the base, wherein each of the associated two die blade block bolts is threadedly-secured within, and extends through, an associated die blade block, wherein each of the two associated die blade blocks is raised or lowered upon rotation of an associated die blade block bolt by reaction of an end of each associated die blade block bolt against the back-up plate, and wherein the associated die blade spring plate is secured to the associated die blade by an associated indent which is punched out of the associated die blade, upon which an edge of the associated die blade spring plate rests, and wherein each of the two associated two perforating knife block bolts is threadedly-secured within, and extends through, an associated perforating knife block, wherein each of the two associated perforating knife blocks is raised or lowered upon rotation of the associated perforating knife block bolt by reaction of an end of each associated perforating knife block bolt against the back-up plate, and wherein the associated perforating knife spring plate is secured to the associated perforating knife by an indent which is punched out of the associated perforating knife, upon which an edge of the associated perforating knife spring plate rests.

By a feature of the third embodiment of the invention and of the above-described features of the first and second embodiments of this invention, the die set includes two longitudinally-spaced-apart die blade blocks, and two longitudinally-spaced-apart perforating knife blocks supporting a respective die blade, and a respective perforating knife, and the central bolt is threadedly-secured to the base, wherein each of the two associated two die blade block bolts is threadedly-secured within, and extends through, an associated die blade block, wherein each of the associated die blade blocks is raised or lowered upon rotation of an associated die blade block bolt by reaction of an end of each associated die blade block bolt against the back-up plate, and wherein the associated die blade spring plate is secured to the associated die blade by an associated indent which is punched out of the associated die blade, upon which an edge of the associated die blade plate rests, wherein each of the two associated two perforating knife block bolts is threadedly-secured within, and extends through, an associated perforating knife block, wherein each of the two associated perforating knife blocks is raised or lowered upon rotation of an associated perforating knife block bolt by reaction of an end of each associated perforating knife block bolt against the back-up plate, and wherein the associated perforating knife spring plate is secured to the associated perforating knife by an associated indent which is punched out of the associated perforating knife, upon which an edge of the associated perforating knife spring plate rests.

By a feature of the fourth embodiment of the invention and of the above-described features of the first, second and third embodiments of this invention, the die set includes two longitudinally-spaced-apart die blade blocks, two longitudinally-spaced-apart perforating knife blocks and two longitudinally-spaced-apart anvils supporting a respective die blade a respective perforating knife, and a perspective anvil and the central bolt is threadedly-secured to the base, wherein each of the two associated two die blade block bolts is threadedly-secured within, and extends through, an associated die blade block, wherein each of the two associated die blade blocks is raised or lowered upon rotation of an associated die blade block bolt by reaction of an end of each associated die blade block bolt against the back-up plate, and wherein the associated die blade spring plate is secured to the associated die blade by an associated indent which is punched out of the associated die blade, upon which an edge of the associated die blade spring plate rests, and wherein each of the associated two perforating knife block bolts is threadedly-secured within, and extends through, an associated perforating knife block, wherein each of the associated perforating knife blocks is raised or lowered upon rotation of an associated perforating knife block bolt by reaction of an end of each associated perforating knife block bolt against the back-up plate, and wherein the associated perforating knife spring plate is secured to the associated perforating knife by an associated indent which is punched out of the associated perforating knife, upon which an edge of the associated perforating knife spring plate rests, and wherein each of the two associated two anvil bolts is threadedly-secured within, and extends through, an associated anvil block, wherein each of the associated anvil blocks is raised or lowered upon rotation of an associated anvil block bolt by reaction of an end of each associated anvil block bolt against the back-up plate, and wherein the associated anvil spring plates is secured to the associated anvil by a slot in the associated anvil, within which an edge of the associated anvil plate is disposed.

By a feature of the fifth embodiment of the invention and of the above-described features of the first, second, third and fourth embodiments of this invention, the die set includes two longitudinally-spaced-apart die blade blocks, and two longitudinally-spaced-apart anvil blocks supporting a respective die blade and a respective anvil, and the central bolt is threadedly-secured to the base, wherein each of the two associated two die blade block bolts is threadedly-secured within, and extends through, an associated die blade block, wherein each of the associated die blade blocks is raised or lowered upon rotation of an associated die blade block bolt by reaction of an end of each associated die blade block bolt against the back-up plate, and wherein an associated die blade spring plate is secured to an associated die blade by an associated indent which is punched out of an associated die blade, upon which an edge of an associated die blade spring plate rests, and wherein each of the two associated anvil block bolts is threadedly-secured within, and extends through, an associated anvil block, wherein each of the associated anvil blocks is raised or lowered upon rotation of an associated anvil block bolt by reaction of an end of each associated anvil block bolt against the back-up plate, and wherein each associated anvil spring plate is secured to an associated anvil by an associated slot in an associated anvil, within which an edge of an associated anvil plate is disposed.

By one feature of the sixth embodiment of the invention, the depth of cut of the die blades is controlled by securing the die blades in a jackable manner to the die set.

By one feature of the seventh embodiment of the invention, the depth of cut of the die blades is controlled by securing the die blades in a jackable manner to the die set, and by backing the perforating knives by means of the jackable anvil.

BRIEF DESCRIPTION OF THE DRAWINGS

In the accompanying drawings,

FIGS. 1 to 9 show a jackably mounted die blade and a jackably mounted anvil combination of copending U.S. patent application Ser. No. 08/907,075, filed Aug. 6, 1997 now U.S. Pat. No. 5,983,765 issued Nov. 16, 1999, the entire contents of which are hereby incorporated herein by reference, which is representative of such mountings of all embodiments of the present invention, in which:

FIG. 1 is a top plan view of a pair of dies in such die set according to one structural embodiment, and also showing the partial outline of a carton to be die cut with a die including the pair of dies of the structural embodiment as shown;

FIG. 2 is a somewhat enlarged top plan view of the left-hand die of the pair of dies in the die set as shown in the embodiment of FIG. 1, the right-hand side being an identical mirror image thereof;

FIG. 3 is a somewhat enlarged bottom plan view of the right-hand die of the pair of dies in the die set as shown in the embodiment of FIG. 1, the left-hand side being an identical mirror image thereof;

FIG. 4 is a section along the line IV—IV of FIG. 2;

FIG. 5 is a section along the line V—V of FIG. 2;

FIG. 6 is a section along the line VI—VI of FIG. 2;

FIG. 7 is a partially-cut-away perspective view of the jack operating mechanism and adjusting means for the anvil according to the structural embodiment as shown in FIG. 1, the jack operating mechanism and adjusting means for the die blade, while not being seen, also being the same;

FIG. 8 is a fragmentary schematic perspective view of a blanking die according to one structural embodiment for making die cut cartons including a reverse cut-score;

FIG. 9 is a fragmentary schematic longitudinal section showing the production of a die cut carton including a reverse cut-score using the blanking die according to the structural embodiment as shown in FIG. 8;

DESCRIPTION OF THE INVENTION

Concisely, it will be seen that the present invention, in its various embodiments and aspects, involves the securement of die blades and/or perforating knives and/or anvils to a die block. There are three alternative ways to secure the die blades and the perforating knives to the die block, namely: (1) the die blades being "jackable" and the perforating knives being "jackable"; (2) the die blades being "jackable" and the perforating knives being "fixed"; and (3) the die blades being "fixed" and the perforating knives being "jackable".

There are two alternative ways to secure the die blades and the anvils to the die block, namely: (1) the die blades being "jackable" and the anvils being "jackable"; and (2) the die blades being fixed and the anvils being "jackable".

In order to avoid the redundant and repetitious description of these various alternatives of "jackable" and "fixed", die blades and/or perforating knives and/or anvils reference will now be made to FIG. 1 to FIG. 9, which show the combination of the die blades being "jackable" and the anvils also being "jackable". In the subsequent description of the present invention, in its various embodiments and aspects in the subsequent FIGS., the terms "jackable" or "jackably mounted" are intended to be an abbreviated description of those mountings as fully described in the aforementioned FIG. 1 to FIG. 9.

Before describing the three apparatus embodiments and aspects of this invention, the following description will provide a generic description of "jackable" or "jackably mounted" die blades and "jackable" or "jackably mounted" anvils and of the operation of the jack operating mechanism. It will be clearly understood that the description of the "jackable" mounting of the perforating knives and of their operation is essentially the same. It will be further noted that this description is provided in the above-referred-to copending U.S. patent application Ser. No. 08/907,075, filed Aug. 6, 1997, now U.S. Pat. No. 5,983,765 issued Nov. 16, 1999.

Figure 1:
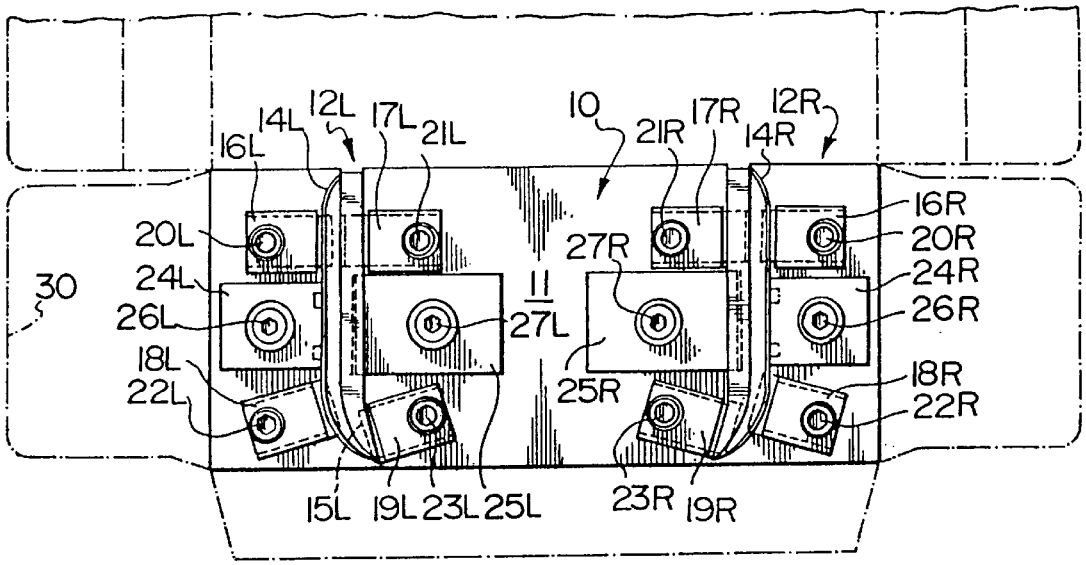
FIG. 1 PRIOR ART
Figure 2:
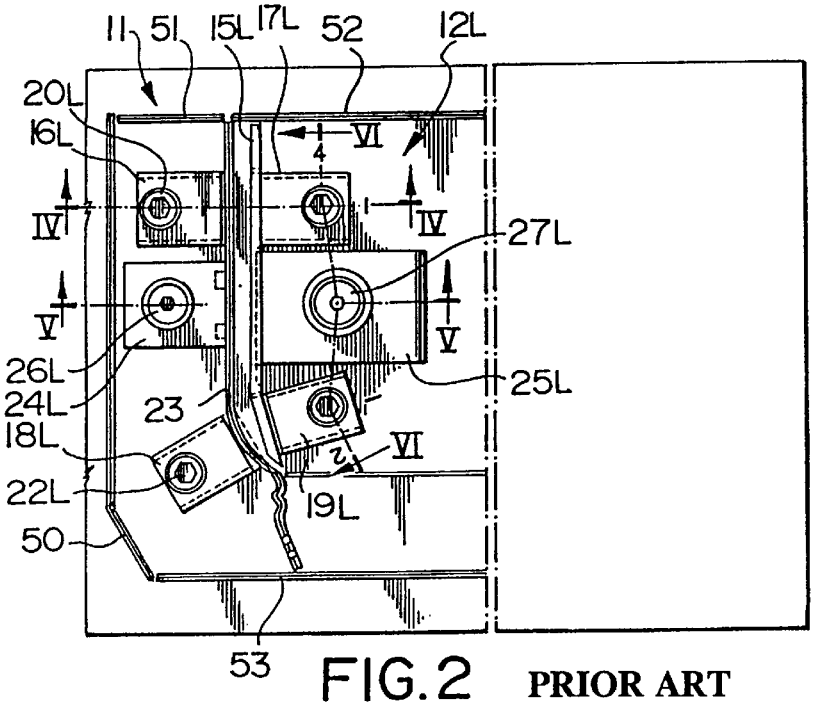
FIG. 2 PRIOR ART
Figure 3:
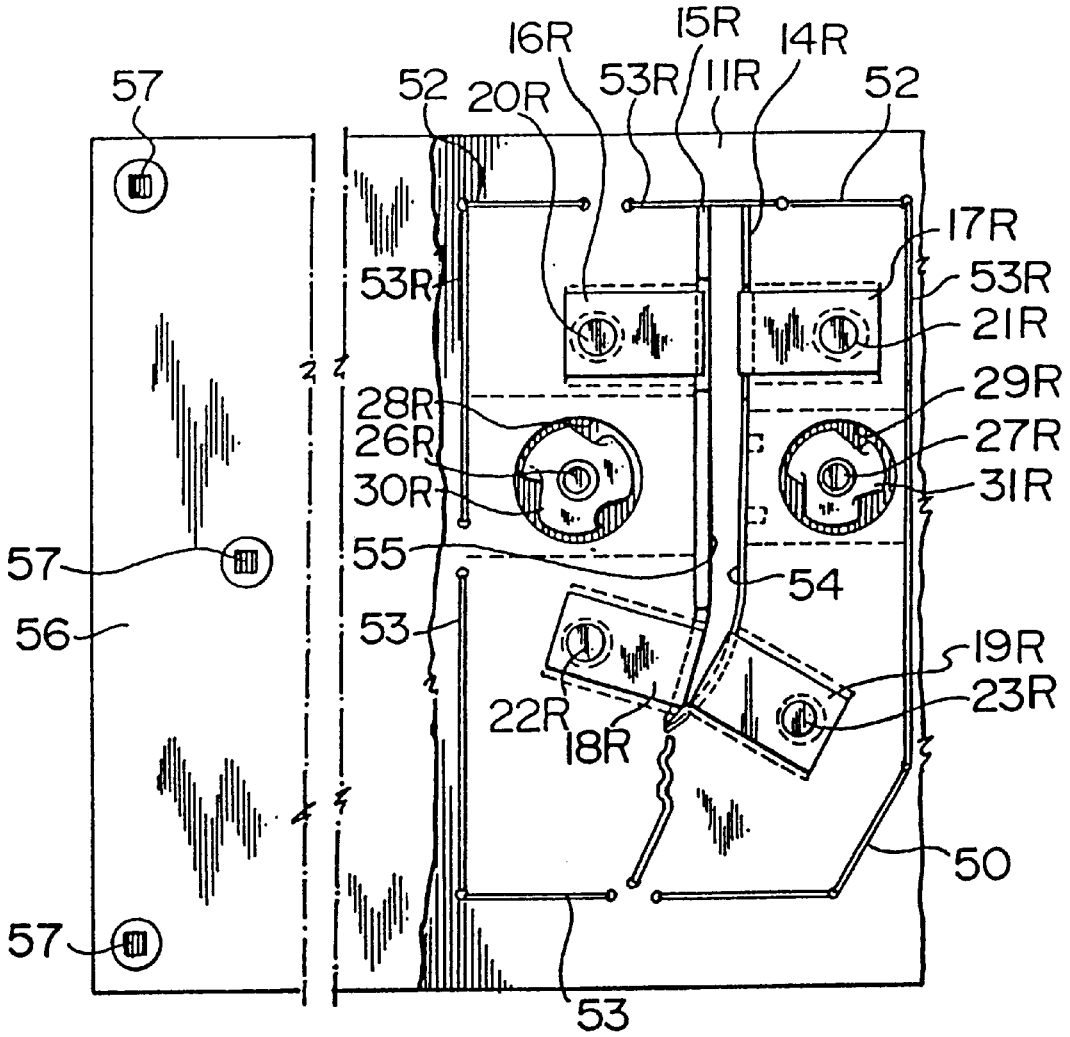
FIG. 3 PRIOR ART

(a) Description of FIG. 1, FIG. 2 and FIG. 3

As seen in FIG. 1, FIG. 2 and FIG. 3, the pair of dies 10 of one embodiment of the invention includes a left-hand side die set 12L and a right-hand side die set 12R.

The left-hand side die set 12L includes a jackable die blade 14L and a jackable steel bar anvil 15L which is set parallel to the die blade 14L. The die blade 14L is secured to wooden block 11 by means of die blade blocks 16L, 18L, which are held to the wooden block 11 by die blade block bolts 20L, 22L. The die blade 14L is retained under continual tension by means of die blade spring plate 24L, which is held to the wooden block 11 by means of central bolt 26L.

The steel bar anvil 15L is secured to wooden block 11 by means of anvil blocks 17L, 19L, which are held to the wooden block 11 by anvil block bolts 21L, 23L. The steel bar anvil 15L is retained under continual tension by means of anvil spring plate 25L, which is held to the wooden block 11 by means of central bolt 27L.

The right-hand side die set 12R is identical to, but is a mirror image of, the left-hand die set 12L, and includes a jackable die blade 14R and a jackable steel bar anvil 15R which is set parallel to the die blade 14R. The die blade 14R is secured to wooden block 11 by means of die blade blocks 16R, 18R, which are held to the wooden block 11 by die blade block bolts 20R, 22R. The die blade 14R is retained under continual tension by means of die blade spring plate 24R, which is held to the wooden block 11 by means of central bolt 26R.

The steel bar anvil 15R is secured to wooden block 11 by means of anvil blocks 17R, 19R, which are held to the wooden block 11 by anvil block bolts 21R, 23R. The steel bar anvil 15R is retained under continual tension by means of anvil spring plate 25R, which is held to the wooden block 11 by means of block bolt 27R.

The outline of the carton is shown as 30. The fixed die blades are shown as 50,51, 52, 53, which are set into laser-formed channels in the wooden block 11. The jackable die blades 14 (i.e., 14L, 14R) are set into laser-formed channels 54 (i.e., 54L, 54R) in wooden block 11, while the jackable anvils 15 (i.e., 54L, 54R) are set into laser-formed channels 55 (i.e.,55L, 55R) in wooden block 11 (see FIG. 4 and FIG. 5).

The location of all the laser-formed channels into which the die blades 14 (i.e., 14L, 14R) and the anvils 15 (i.e., 15L, 15R) are disposed is accurately determined by the shape of the tab which is to be formed in the carton.

FIG. 3 shows the underside of the wooden block 11. As seen in FIG. 3, the wooden block 11 is secured to a steel plate 56 by means of threaded collars or pea-nuts 57.

The bases of die blade blocks 16, 18 (i.e., 16L, 16R, 18L, 18R), when in their lowermost position, rest on the upper surface of steel plate 56. The bases of die blade block bolts 20, 22 (i.e., 20L, 20R, 22L, 22R ) rest on the upper surface of die blade steel plate 56 as a backup plate reaction surface. The central bolt 26 (i.e.,26L, 26R) is set within bore 28 (i.e., 28L, 28R) in wooden block 11 and is secured to lock washer 30 (i.e., 30L, 30R).

The bases of anvil blocks 17, 19 (i.e., 17L, 17R, 19L, 19R), when in their lowermost position, rest on the upper surfaces of steel plate 56. The bases of anvil block bolts 21, 23 (i.e., 21L, 21R, 23L, 23R) rest on the upper surface of steel plate 56 as reaction surface. The central bolt 27 (i.e., 27L, 27R) is set within bore 39 (i.e., 39L, 39R) in wooden block 11 and is secured to lock washer 31 (i.e., 31l, 31R).

Figure 4:
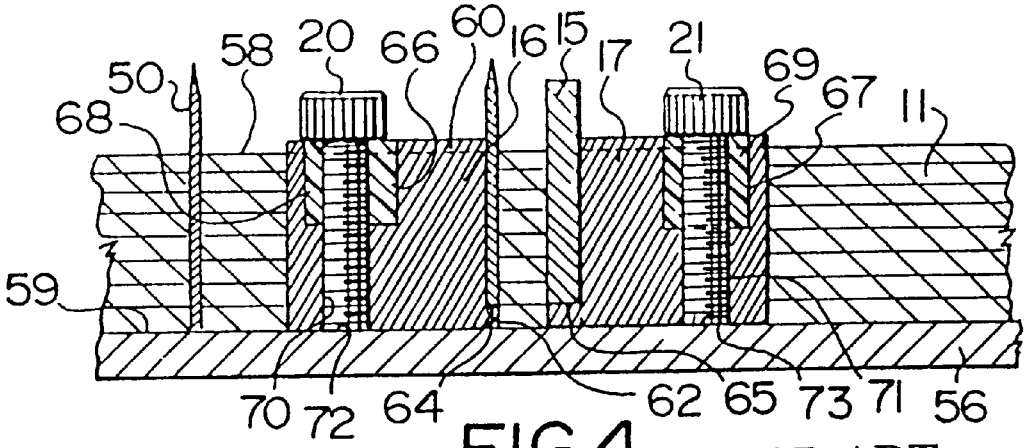
FIG.4 PRIOR ART
Figure 6:
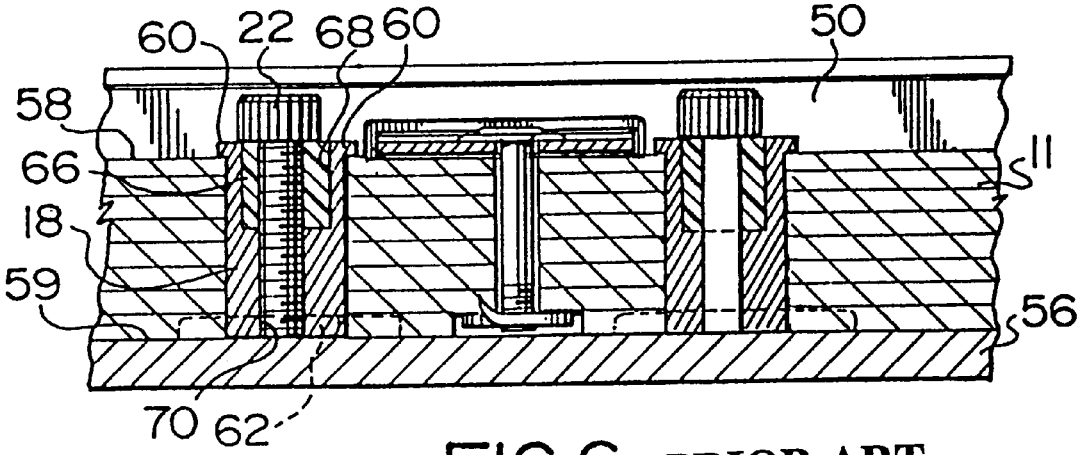
FIG.6 PRIOR ART

(b) Description of FIG. 4 and FIG. 6

As seen more clearly in FIG. 4 and FIG. 6, the die blade blocks 16, 18 are each provided with an upper shoulder 60 to enable the die blade blocks 16, 18 to rest on the top surface 58 of wooden block 11. The die blade blocks 16, 18 are also each provided with a step 62 upon which the lower base 64 of die blades 14 rest. The die blade blocks 16, 18 are furthermore provided with a countersunk well 66. Each die blade block bolt 20, 22 is threaded into eccentric hole 68 in plastic plug 70 until it is fully home. Then, the die blade block bolt/plug combination is threaded into threads 72 in die blade blocks 16, 18. The lower ends 72 of die blade block bolts 20, 22 rest on the upper surface 59 of the steel plate 56.

Figure 5:
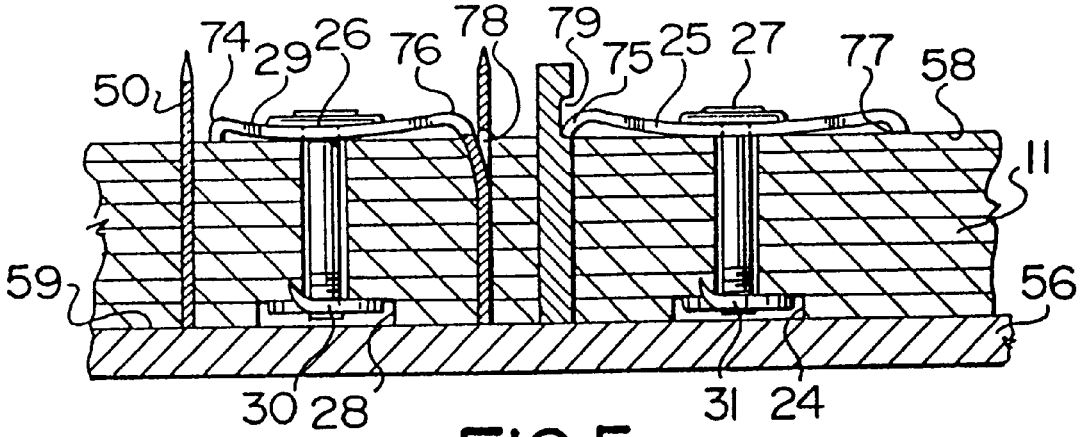
FIG.5 PRIOR ART

(c) Description of FIG. 5

As also seen more clearly in FIG. 4 and FIG. 6, the anvil blocks 17, 19 are each provided with an upper shoulder 61 to enable to enable the anvil blocks 17, 19 to rest on the top surface 58 of wooden block 11. The anvil blocks 17, 19 are also each provided with a step 63 upon which the lower base 65 of anvils 15 rest. The anvil blocks 17, 19 are furthermore provided with a countersunk well 67. Each anvil block bolt 21, 23 is threaded into eccentric hole 69 in plastic plug 71 until it is fully home. Then the anvil block bolt/plug combination is threaded into threads 73 in anvil blocks 17, 19. The lower ends 75 of anvil block bolts 21, 23 rest on the upper surface 59 of the steel plate 56.

(d) Description of FIG. 7

FIG. 5 shows in detail how the jackable die blade 14 and jackable anvil 15 are retained under constant tension. Central bolts 26 hold die blade spring plates 24 by means of engagement with lock washer 30. Die blade spring plates 24 have an outer skirt 74 resting atop the top surface 58 of wooden block 11, and an inner skirt 76 resting on indent 78 which is punched out of die blade 14. It is noted that the central portion of die plates 14 rest with its base 64 on the upper surface 59 of the steel plate 56. The lateral portions of die blades 14 are stepped so that their lateral lower ends 64 can rest on steps 62.

In operation, as seen in FIG. 7, rotation of die blade bolts 20 22 downwardly against the reaction of the upper surface 59 of steel plate 56, causes the die blade blocks 16, 18 to be raised. Conversely, rotation of die blade bolts 21 upwardly in the opposite direction, allows the action of the upper surface 59 of steel plate 56, to causes the die blade blocks 16, 18 to be lowered.

Central bolts 27 hold anvil spring plates 25 by means of engagement with lock washers 31. Anvil spring plates 25 have an outer skirt 77 resting atop upper surface 58 of wooden block 11, and an inner skirt 75 resting in slots 79 which are formed in jackable anvils 15. It is noted that the central portion of jackable anvils 15 rest with their bases 65 on the upper surface 59 of steel plate 56. The lateral portions of the anvils 15 are stepped so that their lateral, lower ends 65 can rest on steps 63.

In operation, rotation of anvil bolts 21, 23 downwardly against the reaction of the upper surface 59 of steel plate 56, causes the anvil blocks 17, 19 to be raised. Conversely, rotation of die blade bolts 21, 23 upwardly in the opposite direction, allows the action of the upper surface 59 of steel plate 56, to causes the anvil blocks 17, 19 to be lowered.

(e) Description of FIG. 8

As seen in FIG. 8, a simplified cutting tool 800 includes an upper or fixed platen 801 to which is secured one die unit 10. However, in commercial practice, there would be sixteen such die units or clones 10 secured to upper platen 801.

The cutting tool 800 also includes a lower or movable platen 802, to which is secured a lower die plate 803. Since there would normally be sixteen die units or clones 10 secured to upper platen 801, there would, similarly, be sixteen such lower die plates 803 secured to lower platen 802.

The lower die plate 803 is provided with a pair of transversely-spaced-apart knife edges 804, 805 which are situated below the anvils of the upper die unit 10. The lower die plate 803 also includes a pair of outer, lateral, pseudo-anvils 806,807. The pseudo-anvils are disposed below the die blades of the upper die unit 10.

A threaded collar or pea-nut secures the die sets 10 to the upper fixed platen 801. Suitable securing means cooperating with slots 808 in the lower die plate 803 secures the lower die plate 803 to the lower (movable) platen 802. The die blade of the upper die 10 and the knife edges of the lower die plate 803 have a raised cutting edge of about $^{25}/_{1000}$". The anvils and the die blades of each of the upper dies 10 can be raised or lowered about $^{6}/_{1000}$" to about $^{7}/_{1000}$" by ½ turn of the block bolt.

Figure 9:
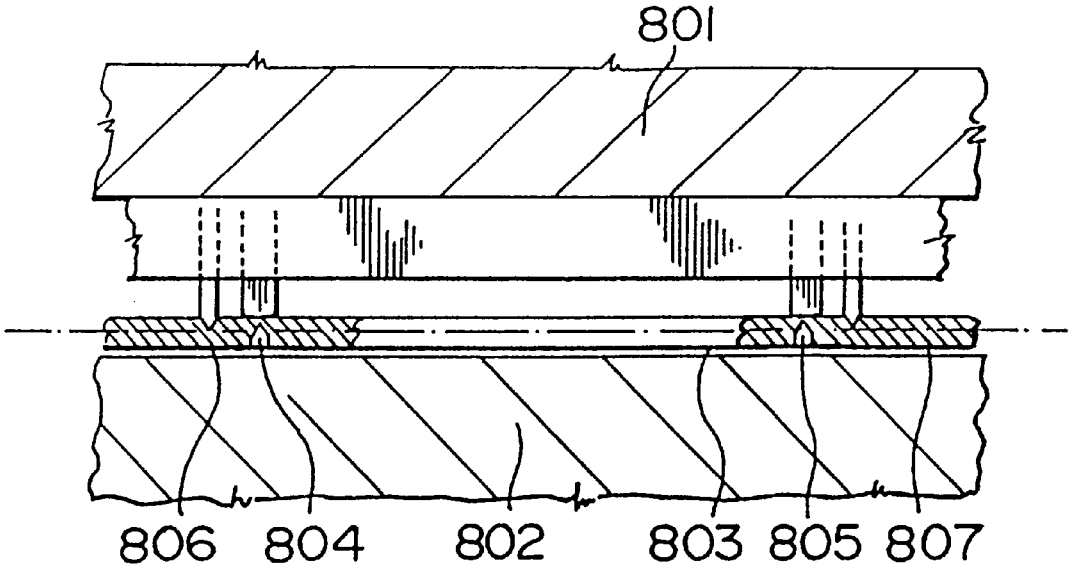
FIG. 9 PRIOR ART

(f) Description of FIG. 9

As seen in FIG. 9, the lower (movable) platen 802 has moved towards the upper (fixed) platen 801 to enable the die sets 10, and the lower die plate 803 to cooperate to provide the reverse cut scores. As will be seen, the knives 804, 805 of the die plate 803 on the lower (movable) platen 802 are aligned with the anvils of the die 10 on the upper (fixed) platen 801. The die blades of the die sets 10 on the upper (fixed) platen 801 are aligned with the pseudo-anvils 806, 807 of the die plate on the lower (movable) platen 802. The partial (half-way) cuts are clearly seen, which provides the reverse cut-scores.

DESCRIPTION OF THE FIRST EMBODIMENT

In the first embodiment of an aspect of this invention, the structural embodiments heretofore described with reference to FIG. 1 to FIG. 9, would be modified as follows for producing tear strips in cardboard cartons. The anvil would be replaced by a perforating knife which would cut completely through the cardboard. The perforating knife would be secured in the same way as the anvil which it replaces, i.e., it would be a "jackable" perforating knife. In this first embodiment of an aspect of this invention, it is essential that the "jackable" die blade and the "jackable" perforating knife converge at one focal or starting point to ensure proper starting of the opening oaf the tear strip.

Figure 10:
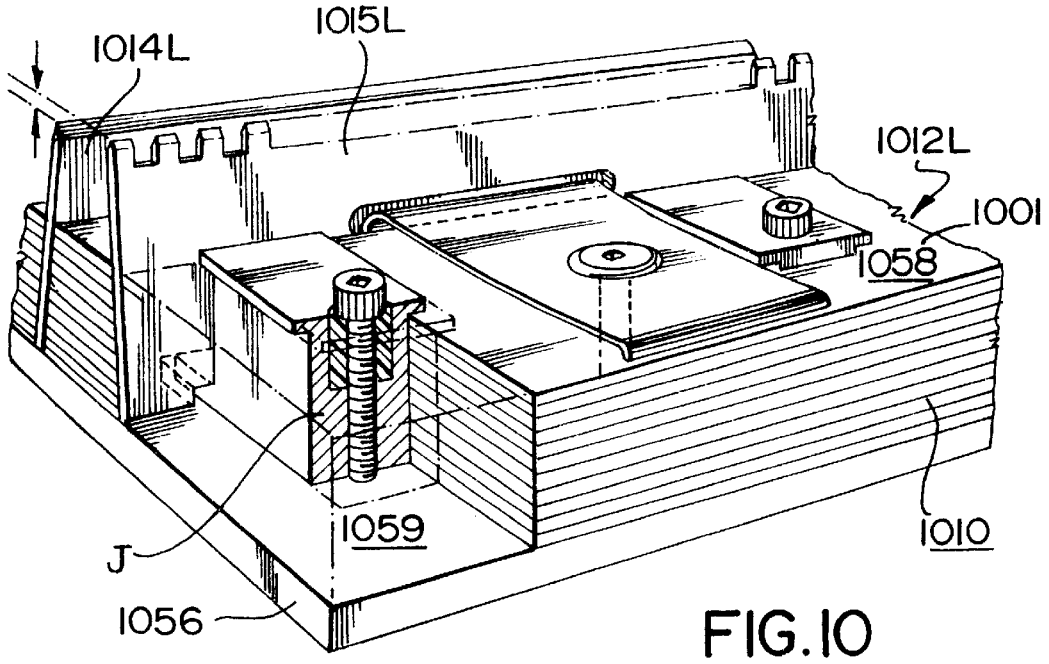
FIG. 10 is a partially-cut-away perspective view of a first embodiment of an aspect of this invention, namely, a partially-cut-away perspective view of the jack operating mechanism and adjusting means for the perforating knife according to the structural embodiment as shown in FIGS. 1 to 9, the jack operating mechanism and adjusting means for the die blade, while not being seen, also being the same as for the structural embodiment as shown in FIGS. 1 to 9.
Figure 11:
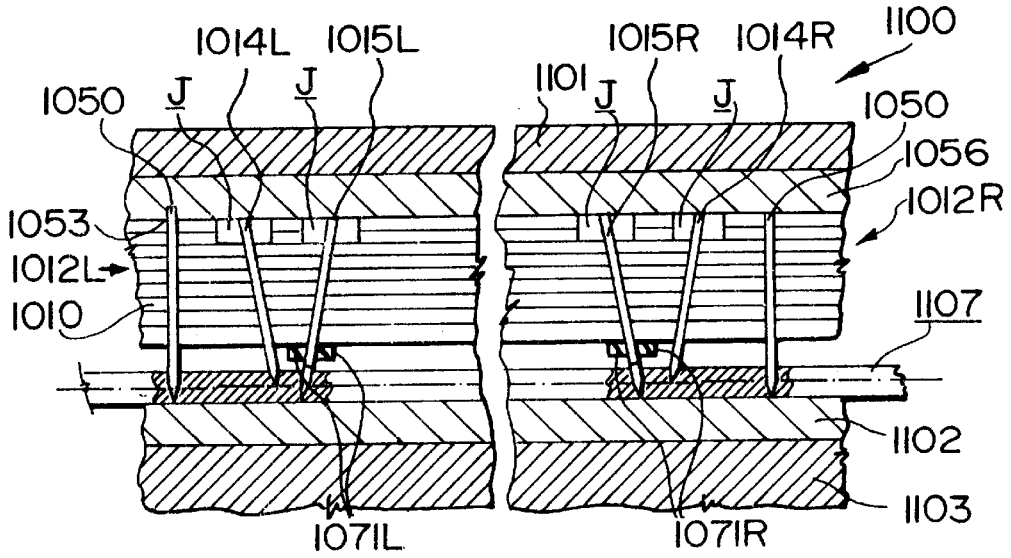
FIG. 11 is a fragmentary schematic longitudinal section showing the production of a die cut carton including a reverse cut-score using the blanking die according to the structural embodiment as shown in FIG. 10.

(a) Description of FIG. 10 and FIG. 11

This first embodiment of an aspect of this invention will now be described with reference to FIG. 10 and FIG. 11.

As seen in FIG. 10, the die block 1010 of the first embodiment of a broad aspect of this invention includes a left-hand side die set and a right-hand side die set of die blades and perforating knives (as was described for the structural embodiment of FIG. 1) but, in this FIG., only the left-hand die set 1012L will be shown, the right-hand side die set being identical to, but being the mirror image of, the left-hand die set 1012L, The left-hand side die set 1012L includes a jackable die blade 1014L and a jackable perforating knife 1015L. The jackable die blade 1014L is secured to wooden block 1010 in a jackable manner as was previously described with reference to FIG. 1 to FIG. 8, and so will not be further described in detail. This "jackable" mounting which was previously described is shown in abbreviated form as BLOCK J, and will not be further described. The die blade 1014L is retained under continual tension by means of die blade spring plate, which is held to the wooden block 11 by means of central bolt.

The jackable perforating knife 1015L is secured to wooden block 1010 in a jackable manner as was previously described with reference to FIG. 1 to FIG. 9, and so will not be further described in detail. This "jackable" mounting which was previously described is shown in abbreviated form as BLOCK J, and will not be further described. The jackable perforating knife 1015L is outlined by compressible rubber mats 1071L (see FIG. 11).

As seen in FIG. 11, the right-hand side die set 1012R is identical to, but is the mirror image of, the left-hand die set 1012L, and includes a jackable die blade 1014R and a jackable perforating knife 1015R. The jackable die blade 1014R is secured to wooden block 1010 in a jackable manner as was previously described with reference to FIG. 1 to FIG. 9, and so will not be further described in detail. This "jackable" mounting which was previously described is shown in abbreviated form as BLOCK J, and will not be further described. The die blade 1014R is retained under continual tension by means of a die blade spring plate, which is held to the wooden block 1010 by means of a central bolt. The die blade 1104R is retained under continual tension by means of the die blade spring plate, which is held to the wooden block 1010 by means of the central bolt.

The jackable perforating knife 1015R is secured to wooden block 1010 in a jackable manner as was previously described with reference to FIG. 1 to FIG. 9, and so will not be further described in detail. This "jackable" mounting which was previously described is shown in abbreviated form as BLOCK J, and will not be further described. The jackable perforating knife 1015R is outlined by compressible rubber mats 1071R (see FIG. 11).

The fixed die blades which provide the perimeter of the carton are shown as 1150, which are set into laser-formed channels 1153 in the wooden block 1010. The location of all the laser-formed channels into which the jackable die blades 1014 and the jackable perforating knives 1015 are disposed is accurately determined by the shape of the tab which is to be formed in the carton.

The "jackable" die blades 1014L, 1014R and the "jackable" perforating knives 1015L, 1015R converge at one focal or starting point to ensure proper starting of the opening of the tear strip.

FIG. 11 shows a simplified die-cutting tool 1100 which includes an upper or fixed platen 1101 to which is secured a base reaction plate 1056, and also to which is secured a back-up plate reaction plate 1056, and also to which is secured one die unit 1012L, 1012R. However, in commercial practice, there would be sixteen such die units or clones 1012L, 1012R which are secured to upper platen 1101. A threaded collar or pea-nut (not seen) secures the die blocks 1010 to the upper fixed platen 1101.

The die-cutting tool 1100 also includes a lower or movable platen 1102, to which is secured a lower base 1103. In contrast to the prior cutting tools, as described, for example, with respect to FIG. 9, the cutting tool 1100 does not include a lower die plate which would have been secured to the lower or movable platen 1102.

Each of the jackable die blades 1014L, 1014R and the jackable perforating knives 1015L, 1015R of the upper die 1010 have a raised cutting edge of about 25/1000". The jackable die blades 1014L, 1014R and the jackable perforating knives 1015L, 1015R of each of the upper die blocks 1010 can be raised or lowered about 6/1000" to about 7/1000" by ½ turn of the block bolt.

As seen in FIG. 11, the lower (movable) platen 1102 has moved towards the upper (fixed) platen 1101 to enable the die blocks 1010, and the lower movable platen 1102 to cooperate to provide the cut score lines and the perforation lines. The platens 1101 and 1102 are so arranged that the jackable die blades 1014L, 1014R and the corresponding jackable perforating knives 1015L, 1015R converge at one focal or starting point at the cardboard 1107 in order to ensure proper starting of the opening of the tear strip in the cardboard 1107. This is clearly seen, in FIG. 11, which shows the provision of the cut-score lines and the perforation lines.

It is also noted that the jackable die blades 1014L, 1014R cut through one-half of the thickness of the cardboard from the top thereof, while the jackable perforating knives 1015L, 1015R cut completely through the cardboard, also from the top thereof. The jackable die blades 1014L, 1014R and the jackable perforating knives 1015L, 1015R make the set-up faster for repeat runs.

DESCRIPTION OF THE SECOND EMBODIMENT

In the second embodiment of an aspect of this invention, the structural embodiments heretofore described with reference to FIG. 1 to FIG. 9, would be modified as follows for producing tear strips in cardboard cartons. The anvils would be retained, and a perforating knife would be added which would cut completely through the cardboard. The perforating knife would be secured in the same way as the anvil and the die blade, i.e., it would be a "jackable" perforating knife. The anvils, being retained, would provide for ease of set-up for repeat runs. In this second embodiment of an aspect of this invention, it is essential that the "jackable" die blade and the "jackable" perforating knife converge at one focal or starting point to ensure proper starting of the opening oaf the tear strip.

Figure 12:
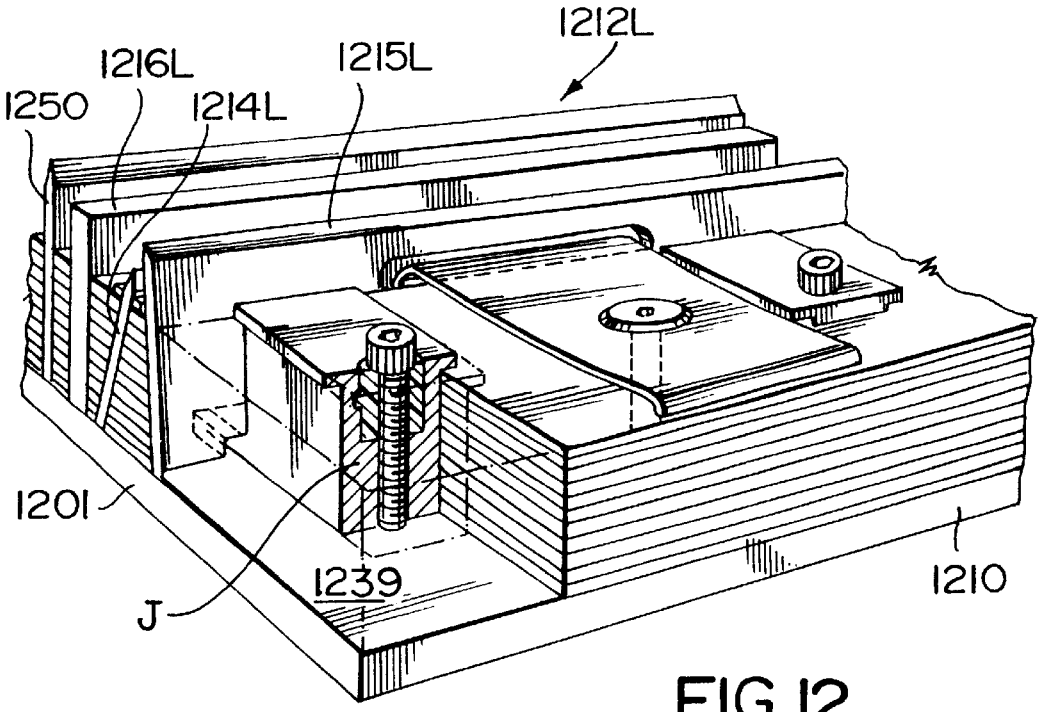
FIG. 12 is a partially-cut-away perspective view of a second embodiment of an aspect of this invention, namely, a partially-cut-away perspective view of the jack operating mechanism and adjusting means for the perforating knife according to the structural embodiment as shown in FIGS. 1 to 9, the jack operating mechanism and adjusting means for the die blade and for the anvil, while not being seen, also being the same as for the structural embodiment as shown in FIGS. 1 to 9.
Figure 13:
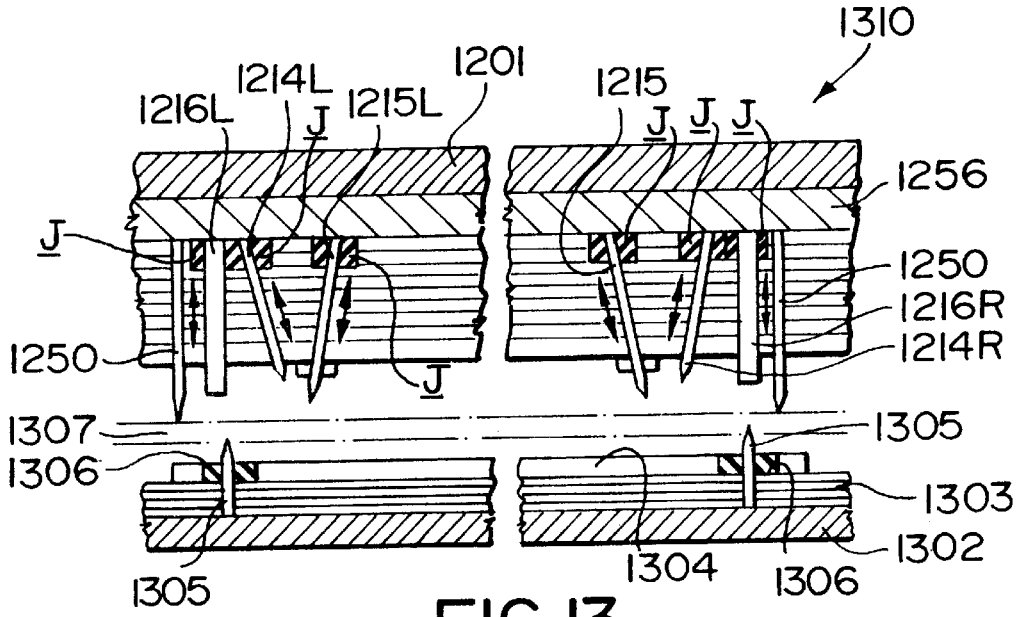
FIG. 13 is a fragmentary schematic longitudinal section showing the production of a die cut carton including a reverse cut-score and perforation line using the blanking die according to the structural embodiment as shown in FIG. 12.

(a) Description of FIG. 12 and FIG. 13

This second embodiment of an aspect of this invention will now be described with reference to FIG. 12 and FIG. 13.

As seen in FIG. 12, the die block 1210 of the second embodiment of a broad aspect of this invention includes a left-hand side die set and a right-hand side die set of die blades and perforating knives (as was described for the structural embodiment of FIG. 1) but, in this FIG., only the left-hand die set 1212L will be shown, the right-hand side die set being identical to, but being the mirror image of, the left-hand die set 1012L.

The left-hand side die set 1212L includes a jackable die blade 1214L, a jackable perforating knife 1215L and a jackable anvil 1216L. The jackable die blade 1014L is secured to wooden block 1210 in a jackable manner as was previously described with reference to FIG. 1 to FIG. 8, and so will not be further described in detail. This "jackable" mounting which was previously described is shown in abbreviated form as BLOCK J, and will not be further described. However, it may be stated that the die blade 1214L is retained under continual tension by means of a die blade spring plate, which is held to the wooden block 1210 by means of a central bolt.

The jackable perforating knife 1215L is secured to wooden block 1210 in a jackable manner as was previously described with reference to FIG. 1 to FIG. 9, and so will not be further described in detail. This "jackable" mounting which was previously described is shown in abbreviated form as BLOCK J, (See FIG. 13) and will not be further described.

The steel bar anvil 1216R is secured to wooden block 1210 in a jackable manner as was previously described with reference to FIG. 1 to FIG. 9, and so will not be further described in detail. This "jackable" mounting which was previously described is shown in abbreviated form as BLOCK J, (See FIG. 13) and will not be further described.

As seen in FIG. 13, the right-hand side die set 1212R is identical to, but is a mirror image of, the left-hand die set 1212L, and includes a jackable die blade 1214R, a jackable perforating knife 1015R and a jackable anvil 1216R. The jackable die blade 1214R is secured to wooden block 1210 in a jackable manner as was previously described with reference to FIG. 1 to FIG. 8, and so will not be further described in detail. This "jackable" mounting which was previously described is shown in abbreviated form as BLOCK J, and will not be further described. However, it may be stated that the die blade 1214R is retained under continual tension by means of a die blade spring plate, which is held to the wooden block 1210 by means of a central bolt. The die blade 1204R is retained under continual tension by means of the die blade spring plate, which is held to the wooden block 1210 by means of the central bolt.

The jackable perforating knife 1215R is secured to wooden block 1210 in a jackable manner as was previously described with reference to FIG. 1 to FIG. 8, and so will not be further described in detail. This "jackable" mounting which was previously described is shown in abbreviated form as BLOCK J, and will not be further described.

The steel bar anvil 1216R is secured to wooden block 1210 in a jackable manner as was previously described with reference to FIG. 1 to FIG. 9, and so will not be further described in detail. This "jackable" mounting which was previously described is shown in abbreviated form as BLOCK J, and will not be further described.

The fixed die blades which provide the perimeter of the carton are shown as 1250, which are set into laser-formed channels in the wooden block 1210.

The location of all the laser-formed channels into which the jackable die blades 1214 (i.e., 1214L, 1214R), the jackable perforating knives 1215 (i.e., 1215L, 1215R) and the jackable anvils 1216 (i.e., 1216L, 1216R) are disposed is accurately determined by the shape of the tab which is to be formed in the carton.

The "jackable" die blades 1014L, 1014R and the "jackable" perforating knives 1015L, 1015R converge at one focal or starting point to ensure proper starting of the opening of the tear strip.

FIG. 13 shows a simplified die-cutting tool 1300 which includes an upper or fixed platen 1301 to which is secured one die unit 1212L, 1212R. However, in commercial practice, there would be sixteen such die units or clones 1212L, 1212R which are secured to upper platen 1301. A threaded collar or pea-nut (not seen) secures the die blocks 1212L, 1212R to the upper fixed platen 1301.

The die-cutting tool 1300 also includes a lower or movable platen 1102, to which is secured a lower base 1303. Since there would normally be sixteen die units or clones 10 secured to upper platen 1301, there would, similarly, be sixteen such lower die plates 1303 secured to lower platen 1302.

The lower die plate 1303 is provided with a pair of transversely-spaced-apart pair of knife edges 1305, which are outlined by compressible rubber pads 1306.

Suitable securing means (not seen) which cooperate with slots in the lower die plate 1303, secure the lower die plate 1303 to the lower (movable) platen 1302. The jackable die blades 1214L, 1214R of the upper die block 1210 each pave a raised cutting edge of 25/1000". The jackable perforating knives 1215L, 1215R of the upper die block 1210 each have a raised cutting edge of 30/1000". The jackable die blades 1014L, 1014R, the jackable perforating knives 1015L, 1015R, and the jackable anvils 1216L, 1216R of each of the upper die blocks 1210 can be raised or lowered 6/1000" to 7/1000" by 112 turn of the block bolt.

As seen in FIG. 13, the lower (movable) platen 1302 has moved towards the upper (fixed) platen 1201 to enable the die blocks 1212L, 1212R and the lower die plate 1303 on the movable platen 1302 to cooperate to provide the cut score lines and the perforation lines. The jackable die blades 1214L, 1214R and the corresponding jackable perforating knives 1215L, 1215R are so mounted on the upper die block 1212 that they converge at one focal or starting point at the cardboard 1107 in order to ensure proper starting of the opening of the tear strip in the cardboard 1107. This is clearly seen, in FIG. 11, which shows the provision of the cut-score lines and the perforation lines.

It is also noted that the jackable die blades 1214L, 1214R cut through one-half of the thickness of the cardboard from the top thereof to provide partial cuts, while the jackable perforating knives 1015L, 1015R cut completely through the cardboard from the top thereof. The jackable die blades 1014L, 1014R, the jackable perforating knives 1015L, 1015R and the jackable anvils 1216L, 1216R make the set-up faster for repeat runs.

DESCRIPTION OF THE THIRD EMBODIMENT

In the third embodiment of an aspect of this invention, the structural embodiments heretofore described with reference to FIG. 1 to FIG. 8, would be modified as follows for producing tear strips in cardboard cartons. The structure of the upper die block 10 of FIG. 1 to FIG. 9 would be completely retained. However, the structure of the lower platen would be changed so that the die blade thereon would become a perforating knife. The anvils, being retained, would provide for ease of set-up for repeat runs. In this third embodiment of an aspect of this invention, it is essential that the "jackable" die blade and the "Fixed" perforating knife converge at one focal or starting point to ensure proper starting of the opening oaf the tear strip.

Figure 14:
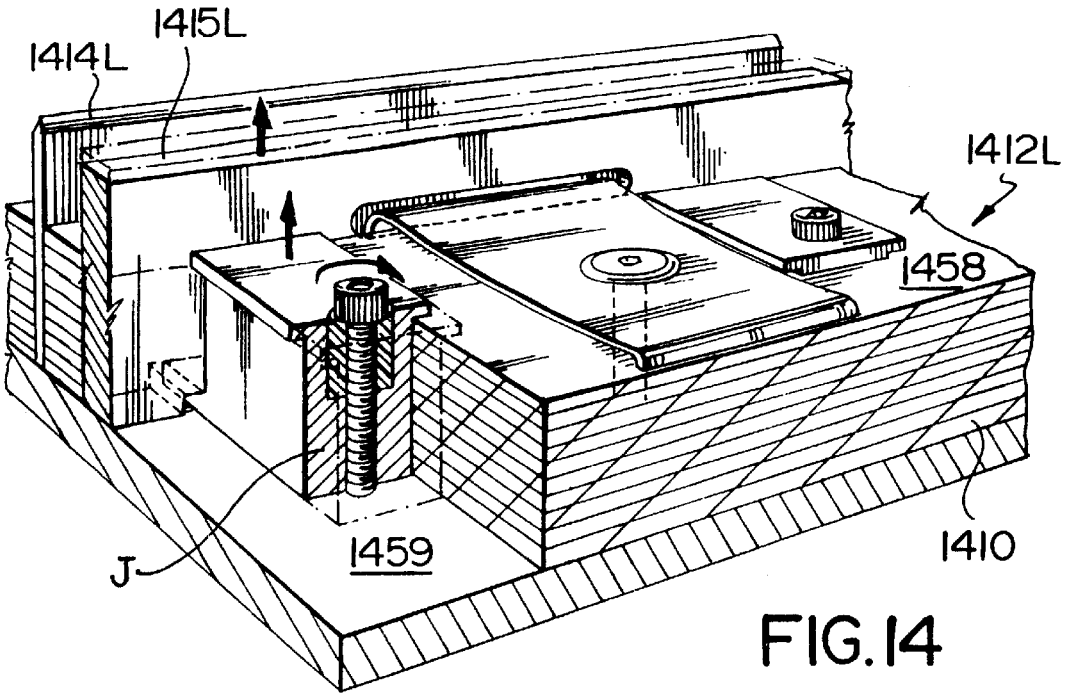
FIG. 14 is a partially-cut-away perspective view of one component of a third embodiment of an aspect of this invention, namely, a partially-cut-away perspective view of the jack operating mechanism and jack operating means for the anvil according to the structural embodiment as shown in FIG. 1 the jack operating mechanism and jack operating means for the die blade, while not being seen, also being the same.
Figure 15:
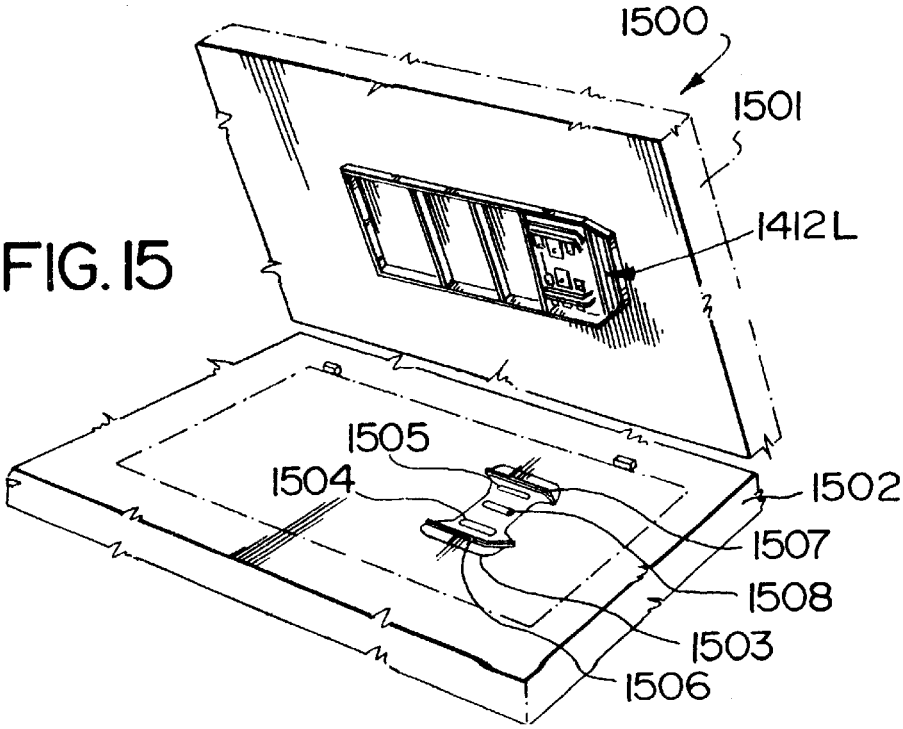
FIG. 15 is a fragmentary schematic perspective view of a blanking die according to a third embodiment of an aspect of this invention, in which one platen comprises one component of the third embodiment as shown in FIG. 14, and in which the other platen conforms to the other component of the third embodiment for making die cut cartons including a reverse cut-score and perforation line.
Figure 16:
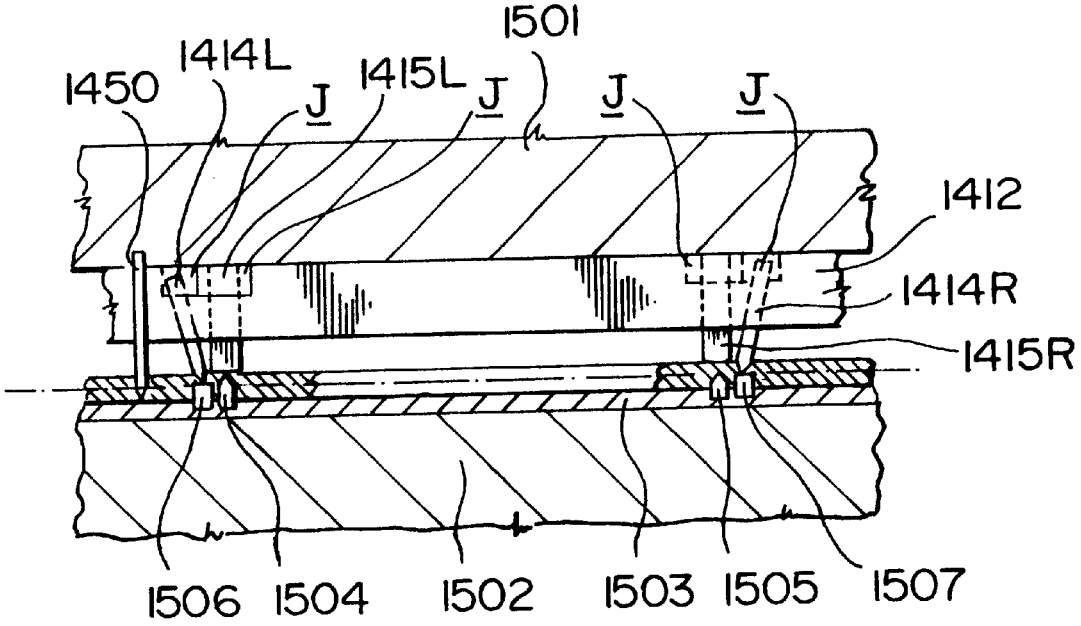
FIG. 16 is a fragmentary schematic longitudinal section showing the production of a die cut carton including a reverse cut-score and perforation line using the blanking die according to the structural embodiment as shown in FIGS. 14 and 15.

(a) Description of FIG. 14, FIG. 15 and FIG. 16

This third embodiment of an aspect of this invention will now be described with reference to FIG. 14, FIG. 15 and FIG. 16.

As seen in FIG. 14, the die block 1412L of the third embodiment of a broad aspect of this invention includes a left-hand side die set and a right-hand side die set of die blades and perforating knives (as was described for the structural embodiment of FIG. 1) but, in this FIG, only the left-hand die set 1412L will be shown, the right-hand side die set being identical to, but being the mirror image of, the left-hand die set 1412L.

The left-hand side die set 1412L includes a jackable die blade 1414L, and a jackable anvil 1415L. The jackable die blade 1414L is secured to wooden block 1410 in a jackable manner as was previously described with reference to FIG. 1 to FIG. 9, and so will not be further described in detail. This "jackable" mounting which was previously described is shown in abbreviated form as BLOCK J, and will not be further described. However, it may be stated that the die blade 1414L is retained under continual tension by means of a die blade spring plate, which is held to the wooden block 1410 by means of a central bolt.

The jackable steel bar anvil 1416L is secured to wooden block 1410 in a jackable manner as was previously described with reference to FIG. 1 to FIG. 9, and so will not be further described in detail. This "jackable" mounting which was previously described is shown in abbreviated form as BLOCK J, (See FIG. 16 and will not be further described.

The right-hand side die set 1412R (see FIG. 16) is identical to, but is a mirror image of, the left-hand die set 1412L, and includes a jackable die blade 1414R and a jackable anvil 1415R. The jackable die blade 1414R is secured to wooden block 1410 in a jackable manner as was previously described with reference to FIG. 1 to FIG. 9, and so will not be further described in detail. This "jackable" mounting which was previously described is shown in abbreviated form as BLOCK J, and will not be further described. However, it may be stated that the die blade 1414R is retained under continual tension by means of a die blade spring plate, which is held to the wooden block 1410 by means of a central bolt. The die blade 1404R is retained under continual tension by means of a die blade spring plate, which is held to the wooden block 1411 by means of the central bolt.

The steel bar anvil 1415R is secured to wooden block 1410 in a jackable manner as was previously described with reference to FIG. 1 to FIG. 9, and so will not be further described in detail. This "jackable" mounting which was previously described is shown in abbreviated form as BLOCK J, and will not be further described.

The fixed die blades which provide the perimeter of the carton are shown as 1456, which are set into laser-formed channels in the wooden block 1410.

The location of all the laser-formed channels into which the jackable die blades 1414 (i.e., 1414L, 1414R), and the jackable anvils 1215 (i.e., 1215L, 1215R) are disposed is accurately determined by the shape of the tab which is to be formed in the carton.

The "jackable" upper die blades 1014L, 1014R and the "Fixed" lower perforating knives 1505 converge at one focal or starting point to ensure proper starting of the opening of the tear strip.

FIG. 15 shows a simplified die-cutting tool 1500 which includes an upper or fixed platen 1501 to which is secured one die unit 1412L, 1412R. However, in commercial practice, there would be sixteen such die units or clones 1412L, 1412R which are secured to upper platen 1501. A threaded collar or pea-nut (not seen) secures the die blocks 1410 to the upper fixed platen 1501.

The cutting tool 1500 also includes a lower or movable platen 1502, to which is secured a lower die plate 1503. Since there would normally be sixteen die units or clones 1410 secured to upper platen 1501, there would, similarly, be sixteen such lower die plates 1503 secured to lower platen 1502.

The lower die plate 1503 is provided with a pair of transversely-spaced-apart pair of perforating knife edges 1504, 1505, which are situated below the anvils 15151, 1515R of the upper die unit 1412L. The lower die plate 1503 is also provided with a pair of outer, lateral transversely-spaced-apart pair pseudo-anvils 1506, 1507. These pair pseudo-anvils 1506, 1507 are disposed below the associated die blades 1414L, 1414R of the upper die unit 1412L.

A threaded collar or pea-nut (not seen) secures the die blocks 1510 to the upper fixed platen 1501. Suitable securing means (not seen) which cooperate with slots in the lower die plate 1503, secure the lower die plate 1503 to the lower (movable) platen 1502. The jackable die blades 1414L, 1414R of the upper die block 1410 each have a raised cutting edge of about 25/1000". The perforating knife edges 1504, 1505 each have a raised cutting edge of about 30/1000". The anvils 1415L, 1415R and the die blades 1414L, 1414R of each of the upper dies 1610 can be raised or lowered about 6/1000" to about 7/1000" by ½ turn of the block bolt.

As seen in FIG. 16, the lower (movable) platen 1502 has moved towards the upper (fixed) platen 1501 to enable the die sets 1410, and the lower die plate 1503 to cooperate to provide the perforating cut scores. As well be seen, the perforating knife edges 1504, 1505 of the die plate 1503 on the lower (movable) platen 1502 are aligned with the anvils 1415L, 1415R of the die 1412 on the upper (fixed) platen 1501. The die blades 1414L, 1414R of the die sets 1412 on the upper (fixed) platen 1501 are aligned with the pseudo-anvils 1506, 1507 of the die plate 1503 on the lower (movable) platen 1502. The partial (half-way) cuts are clearly seen, which provides reverse cut-scores.

The jackable die blades 1414L, 1414R on the upper die block 1412 and their corresponding perforating knives 1504, 1505 on the lower die plate 1503 approximately converge adjacent one focal starting point to ensure proper starting of the opening tear.

Figure 17:
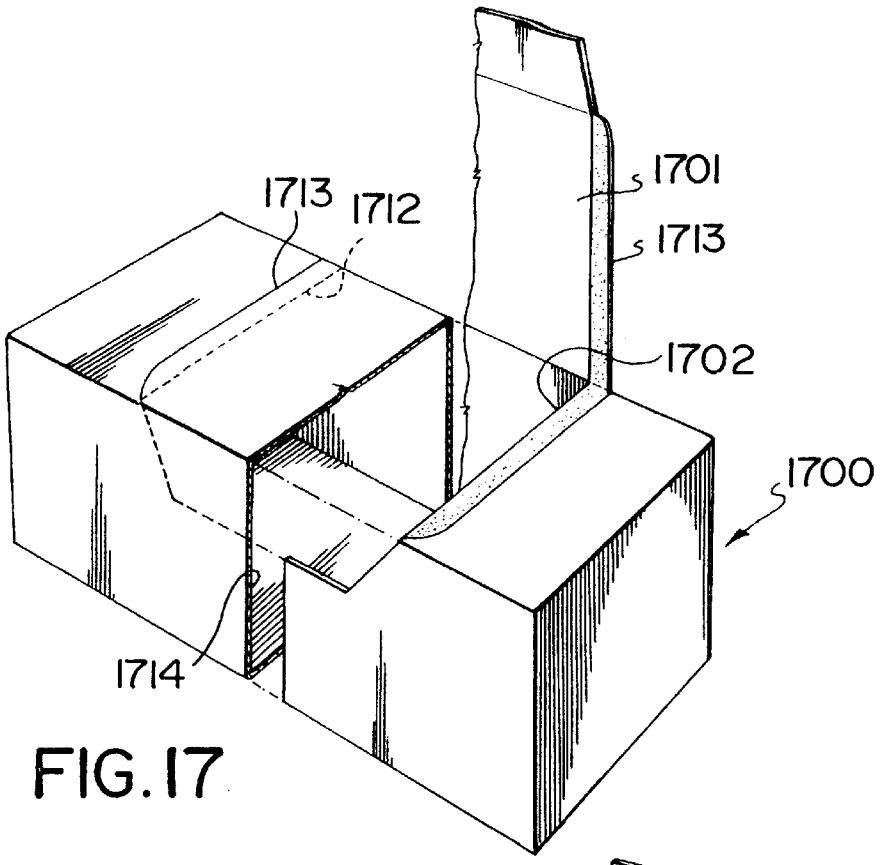
FIG. 17 is a perspective view of a corrugated cardboard carton including a reclosable tab formed with a reverse cut-score and perforation line using the embodiments of the invention as shown in FIGS. 10 to 13.

DESCRIPTION OF ONE EMBODIMENT OF OPENABLE AND CLOSABLE TAB (a) Description of FIG. 17

The openable and closable tab 1701 may be formed by the systems of either the first embodiment of the invention or the second embodiment of this invention, the operation of which was schematically illustrated in FIG. 11 to FIG. 13, is shown in FIG. 17. The carton 1700 includes an openable and closable tab 1701. To form such tab 1701, the inner 1712 of the two cut lines which are the cut-score lines, are formed by the jackable die blades of the upper die block and the outer 1713, of the cut lines, which are the perforation lines, are formed by cutting out a similar but somewhat larger area by means of the jackable perforating knives of the upper die block. The lower platen provides a solid surface against which the respective die blades and perforating knives may cooperate by converging at the region of the lower platen. The cutting, both by the die blades and the perforating knives is at the front face of the cardboard, i.e., it provides a simultaneous cut-score line approximately half-way through the cardboard and the perforation lines completely through the cardboard Thus the corrugated cardboard is simultaneously cut approximately half-way through from the top and, in a slightly laterally offset but converging perforated manner also completely, and also from the top. When the cardboard is torn away along the cut-score lines and along the perforated lines, an openable and reclosable tab 1715 is formed.

Figure 18:
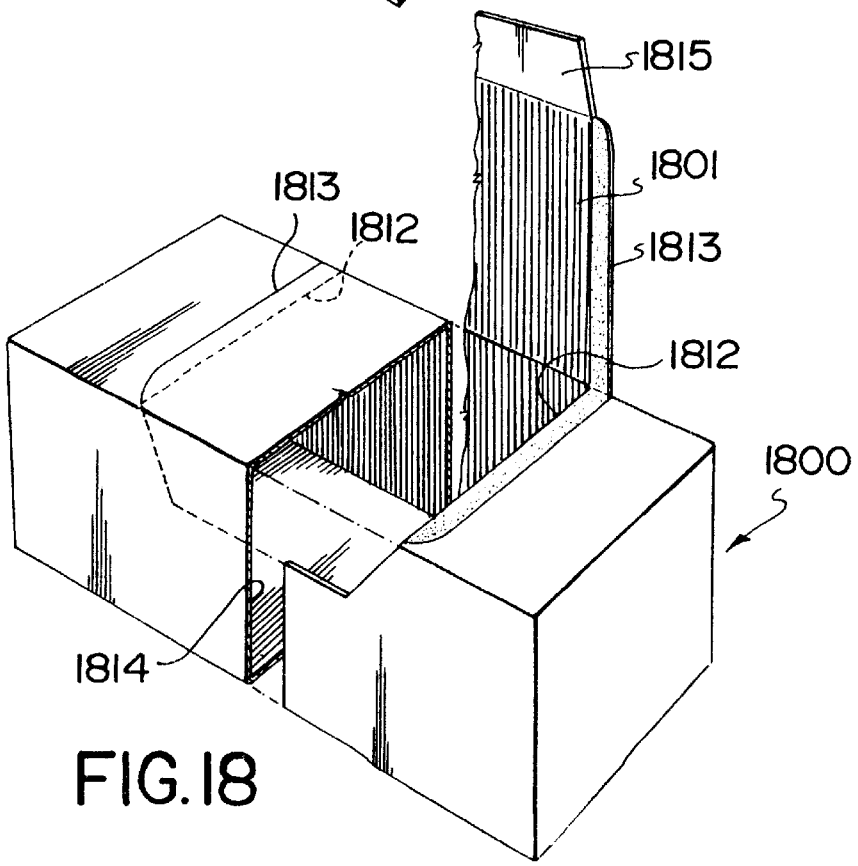
FIG. 18 is a perspective view of a corrugated cardboard carton including a reclosable tab formed with a reverse cut-score and perforation line using the embodiments of the invention as shown in FIGS. 14 to 16.

DESCRIPTION OF ANOTHER EMBODIMENT OF OPENABLE AND CLOSABLE TAB (a) Description of FIG. 18

The openable and closable tab 1801 may be formed by the system of the third embodiment of this invention, the operation of which was schematically illustrated in FIG. 14, FIG. 15 and FIG. 16, is shown in FIG. 18. The carton 1801 includes an openable and closable tab 1801. To form such tab 1801, the inner 1812 of the cut lines are the perforation cuts, which are formed by cutting out an area by means of the perforating knives on the lower platen cooperating with the die blades on the upper die plate. The lower platen also provides a solid surface against which the die blades of the upper die block and the pseudo-anvils of the lower platen may cooperate. The cutting by the die blades is approximately half-way through the cardboard from at the front face of the cardboard, while the cutting by the perforating knives is completely through from the bottom face of the cardboard. This operation provides simultaneous cut-score lines and perforation lines. The cardboard is simultaneously cut in a manner completely, from the bottom. When the cardboard is torn away along the perforated lines 1912, an openable and reclosable tab 1915 is formed.

DESCRIPTION OF OPERATION OF THE INVENTION (a) Description of Operation of the Jackable Die Blades With respect to the operation of the respective associated jackable die blades, because the die blade block bolts are threaded into their respective associated eccentric plastic collars first, and then into the respective associated threads of the respective associated steel block, the respective associated die blade block bolts are constantly under bending pressure. This provides a self-locking action regardless of the rotational position of the respective associated die blade block bolts. Since the respective associated die blade block bolts are not free to rotate, this keeps the respective associated die blades in position whenever the respective associated die blades are raised or lowered.

The securing of the respective associated die blade spring plates to the respective associated jackable die blades and to the wooden block, is by means of the respective associated downwardly-depending forward edge of the respective associated die blade spring plates being engaged with the respective associated indents on the respective associated die blades. The respective associated central bolts then pass through the respective associated central apertures in the respective associated die blade spring plates and through respective associated steel collars through the wooden block, to be engaged by respective associated lower lock nut/washers inset within respective associated countersunk holes in the lower base of the wooden block. Tightening of the respective associated central bolt urges the respective associated die blade spring plates into tension with the respective associated rear depending portions thereof being pressed against the top face of the wooden block.

Thus, the respective associated die blade spring plates urge and draw the respective associated jackable die blades onto the wooden block and trap the respective associated die blades within the die set. The respective associated central bolt has a niche in it to provide a starting point.

(b) Description of Operation of the Jackable Perforating Knives

With respect to the operation of the respective associated jackable perforating knives, because the respective associated perforating knife block bolts are threaded into their respective associated eccentric plastic collar first, and then into the respective associated threads of the respective associated steel block, the respective associated perforating knife block bolts are constantly under bending pressure. This provides a self-locking action regardless of the rotational position of the respective associated perforating knife block bolts. Since the respective associated perforating knife block bolts are not free to rotate, this keeps the respective associated perforating knives in position whenever the respective associated perforating knives are raised or lowered.

The securing of the respective associated perforating knife spring plate to the jackable perforating knives and to the wooden block, is by means of the respective downwardly-depending forward edge of the respective associated perforating knife spring plate being engaged with the indents on the respective associated jackable perforating knives. The respective associated central bolt then passes through the respective associated central aperture in the respective associated perforating knife spring plate and through respective associated steel collars through the wooden block to be engaged by respective associated lower lock nut/washers inset within respective associated countersunk holes in the respective associated lower base of the wooden block. Tightening of the respective associated central bolt urges the respective associated perforating knife spring plate into tension with the respective associated rear depending portion thereof pressed against the top face of the wooden block. Thus, the respective associated perforating knife spring plate urges and draws the respective associated perforating knives onto the wooden block and traps the respective associated perforating knives within the respective associated die set. The respective associated central bolt has a niche in it to provide a starting point.

(c) Description of Operation of the Jackable Anvils

With respect to the operation of the respective associated jackable anvils, because the respective associated anvil block bolts are threaded into its respective associated eccentric plastic collars first, and then into the respective associated threads on the steel blocks, the respective associated anvil block bolts are constantly under bending pressure. This provides a self-locking action regardless of the rotational position of the respective associated anvil block bolts. Since the respective associated anvil block bolts are not free to rotate, this keeps the respective associated anvils in position whenever the respective associated anvils are raised or lowered. The securing of the respective associated anvil spring plates to the respective associated anvils and to the wooden block, is by means of the respective associated downwardly-depending forward edges of the respective associated anvil spring plates are engaged within the respective associated transverse slot in the respective associated anvils. The respective associated central bolts then pass through the respective associated central apertures in the respective associated anvil spring plates and through respective associated steel collars through the wooden block to be engaged by respective associated lower lock nut/washers inset within respective associated countersunk holes in the lower base of the wooden block. Tightening of the respective associated central bolt urges the respective associated anvil spring plates into tension with the respective associated rear depending portions thereof pressed against the top face of the wooden block. Thus, the respective associated anvil spring plates urge and draw the respective associated anvil onto the wooden block and trap the respective associated anvil within the respective associated die set. The respective associated central bolt has a niche in it to provide a starting point.

(d) Description of Controlling the Height of the Die Blades

In operation, to control the height of the respective associated die blade, turning one respective associated die blade block bolt raises the respective associated die blade steel blocks at one end of the respective associated die blade by the reaction of the respective associated die blade bolts against the steel base plate. Turning the respective associated other die blade block bolts in the same direction raises the respective associated die blade steel blocks at the other end of the respective associated die blades. Since the respective associated die blade rests on the steps of both of the respective associated die blade steel blocks, this raises the respective associated die blade as well. Raising the respective associated die blade flexes the respective associated die blade steel spring and increases the tension on the respective associated die blade steel spring. Turning the respective associated die blade bolts in the opposite direction lowers the respective associated die blade by the downward force due to the tension on the respective associated die blade steel spring. The tension in the respective associated die blade steel spring holds the respective associated die blade in the raised or lowered position. The die blade block bolts are so adjusted that, when turned, they raise or lower the respective associated die blade by one-thousandth of an inch per quarter turn. Index digits 1, 2, 3, 4 are provided in the wooden block to assist in adjustment of the respective associated die blade block bolts.

(e) Description of Controlling the Height of the Perforating Knives

In operation, to control the height of the respective associated jackable perforating knives, turning one respective associated perforating knife block bolt raises the respective associated perforating knife steel blocks at one end of the respective associated perforating knives by the reaction of the respective associated perforating knife block bolts against the steel base plate. Turning the respective associated other perforating knife block bolts in the same direction raises the respective associated perforating knife steel blocks at the other end of the respective associated perforating knives. Since the respective associated perforating knives rest on the steps of both of the respective associated perforating knife steel blocks, this raises the respective associated perforating knives as well. Raising the respective associated perforating knives flexes the respective associated perforating knife steel spring and increases the tension on the respective associated perforating knife steel spring. Turning the respective associated perforating knife block bolts in the opposite direction lowers the respective associated perforating knives by the downward force due to the tension on the respective associated perforating knife steel spring. The tension in the respective associated perforating knife steel spring holds the respective associated perforating knives in the raised or lowered position. The respective associated perforating knife block bolts are so adjusted that, when turned, they raise or lower the respective associated perforating knives by one-thousandth of an inch per quarter turn. Index digits 1, 2, 3, 4 are provided in the wooden block to assist in adjustment of the respective associated die blade block bolts.

(f) Description of Controlling the Height of the Anvils

In operation, to control the height of the respective associated jackable anvil, turning one respective associated anvil block bolt raises the respective associated anvil steel blocks at one end of the respective associated anvils by the reaction of the respective associated anvil block bolts against the steel base plate. Turning the other respective associated anvil block bolts in the same direction raises the respective associated anvil steel block at the other end of the respective associated anvil. Since the respective associated anvil rests on the steps of both of the respective associated anvil steel blocks, this raises the respective associated anvils as well. Raising the respective associated anvils flexes the anvil steel spring and increases the tension on the respective associated anvil steel springs. Turning the respective associated anvil block bolts in the opposite direction lowers the respective associated anvil by the downward force due to the tension on the respective associated anvil steel springs. The tension in the respective associated anvil steel springs holds the respective associated anvils in the raised or lowered position.

The respective associated anvil block bolts are so adjusted that, when turned, they raise or lower the respective associated anvils by one-thousandth of an inch per quarter turn. Index digits 1, 2, 3, 4 are provided in the wooden block to assist in adjustment of the respective associated anvil block bolts.

The fixed perforating blades are on the die sets and on the lower die plate, are not adjusted. However, the surrounding resilient rubber pads assist in the die cutting operation, as in the prior art. The converging of the die blades and the perforating blades, to a common focal point or starting point, when the upper and lower platens are brought together, ensures a proper starting point for the opening tear.

(g) Description of Controlling the Adjustability of the Anvils, the Die Blades and the Perforating Knives As noted above, the jackable anvils and/or the die blades and/or the perforating knives are independently adjustable to within about 0.005" by means of the socket head or machine screws (i.e., the die blade block bolts, and/or the anvil block bolts, and/or the perforating knife block bolts). It is possible to adjust the cutting depth of the jackable die blades and/or the jackable perforating knives independently of one another. The reduced set up time of die presses increases the life of the die and minimizes die repairs.

The jackable anvils and/or the jackable die blades and/or jackable perforating knives are independently adjustable to within about 0.005" by means of a respective anvil and/or die blade and/or perforating knife socket head screw or machine bolt. These are used to raise (jack) and lower the respective cutting anvil (bar) which is a steel bar and/or the die blades and/or the perforating knives by one-half of a thousandth of an inch. It is possible to adjust the cutting depth of these die blades and/or these perforating knives independently of one another. The jackable anvils and/or the jackable die blades and/or the jackable perforating knives are adjustable from either end.

The cutting for the score-cut lines and the perforation lines may be exclusively from the top, or the cut-score lines may be from the top and the perforation lines may be from the bottom.

The die sets of these three embodiments of aspects of the invention are used to make a cardboard carton which can be sealed shut, torn open at the perforation line and a cut-score line and then reclosed and opened a plurality of times. The cut-score is carried out by means of the metal plate knife edges on an upper die cutting plate with a raised cutting edge of about $^{25}/_{1000}$", and the perforation cuts may be carried out either from the top or from the bottom.

GENERALIZED SUMMARY OF THE INVENTION

One embodiment of the present invention resides in the provision of an anvil into the die set which is supported upon the fixed platen. This anvil is so arranged that the exposed surface of the anvil is spaced from the surface of the die cutting plate by an amount by which the depth of the cut of the die blade.

Yet another embodiment of the present invention resides in the provision of a jackable die blade into the die set which is supported upon the movable platen against reaction faces of the die cutting plate may cooperate.

Yet still another embodiment of the present invention resides in the provision of a perforating knife which may be a jackable perforating knife which is mounted in the die set in exactly the same manner as the die blade is jackably mounted, the only difference being the compressible rubber pads outlining the perforating knife. Alternatively, the perforating knife may be a fixedly mounted knife in the die set. Still further alternatively, the perforating knife may be a fixedly mounted knife on the lower die plate on the lower platen. Such perforating knife cooperates with a jackable die blade in a manner by which the die blade and the perforating knife converge to a common focal point or starting point to ensure a proper starting point for the opening tear.

According to the system of two embodiments of this invention, the inner of the two die cut lines is formed by the upper die cut blades cutting halfway through the corrugated cardboard from the top, to provide a cut-score, and the outer of the two side-by-side die cut lines is formed by cutting out a similar, somewhat larger, area by means of the perforating knives in the upper die cutting completely through, as a perforation line, the corrugated cardboard from the top. It is noted that the die blades are jackable to control the depth of the partial cut. In one embodiment, of these aspects, the perforating knives may be jackable (for ease of set-up) or, in another embodiment, they may be fixed. In both embodiments, the perforating cuts completely through the cardboard from the top.

According to the system of a third embodiment of this invention, the inner of the die cut lines are completely cut through from the bottom as perforation lines, which are formed by perforating knives which are mounted on a lower die cutting plate. The outer of the two side-by-side lines is formed by cutting out a similar, somewhat larger, area partially through from the top using the upper die plate. An anvil is provided in the upper die within the area defined by the tear strip and this anvil provides a solid surface against the cardboard. In this third embodiment, the lower platen is provided with a die plate which includes perforation knives which are disposed to align with the anvils on the upper die plate of the upper platen, and with pseudo-anvils which are disposed below the die blades on the upper die plate of the upper platen.

The following are some of the advantages of aspects of this invention:

(a) Cutting of the carton, score-cuts and perforation cuts are simultaneously provided.

(b) The cut-score and perforation cut are coextensive to provide a starting point.

(c) Generally, the production load would have sixteen die units or clones, and the machine is adapted to carry out about 7000 to about 10,000 impressions per hour.

(d) There is a much higher level of cutting stability by the reverse cut-scores and main scores.

(e) The dies maintain an even balance.

(f) There is more positive and faster adjustment because of the steel on steel action.

(g) The spongy compression variable effect due to the use of make-ready tape has been eliminated.

(h) The blades and anvils can be fine tuned during the run to accommodate any changes in stock density, composition or moisture content, thereby providing more consistency over a long run.

(i) The cut-to-cut ratio of the opening feature can be better maintained.

(j) The original spot sheet can be re-used, and no set-up but only fine tuning is required on repeat order.

(k) No special operator skills are required since set-up is first done conventionally, and then the system of this invention is used to complete the setting.

(1) Numbers are provided on the back-up block to assist in adjustment, and the machine bolt has a niche on it to provide a starting point.

(m) The system eliminates the transfer effect created when using the prior technique of the use of tape.

(n) The system is not affected by the foot print of the press.

(o) The system eliminates additional crease pressure and damage to the cut at the intersection of the reverse cut-score, the main scores, the crease and the wave cut rule caused by existing conventional method.

(p) The system eliminates the need for frequent re-knives (q) The system allows the optimum operation of the opening feature which is achievable with optimum operation and the quality of the opening feature can be maintained.

(r) The system eliminates the preparation of a new spot sheet each time the job goes to press as was the case when done conventionally.

(s) The system can be confidently used with cardboard having a thickness o 0.016".

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What is claimed is:

1. An apparatus for substantially-simultaneously die cutting cardboard sheets for forming folded cardboard cartons having an openable and closable tab, said apparatus comprising:

(I) a first, upper, platen, said first, upper platen having secured thereto a plurality of side-by-side mounted die sets, each said die set including a plurality of cutting knives, which are secured within a main block, said cutting knives being fixed into a preselected pattern of grooves within said main block, said die set further including: (i) at least one transversely-spaced-apart pair of a die blade and a perforating knife, each said pair of said die blade and said perforating knife being secured within said main block, and in each said pair of said die blade and said perforating knife, said die blade and said perforating knife being slanted vertically towards one another about a vertical axis; (ii) separate securing means securing each said die blade and each said perforating knife of said at least one transversely-spaced-apart pair of a die blade and a perforating knife to said main block; (iii) manually-actuatable means for selectively, separately, individually and directly adjusting said separate securing means for selectively, separately, individually, positively and directly, raising a selected one of each said die blade and said perforating knife of said at least one transversely-spaced-apart pair of a die blade and a perforating knife, and for selectively, separately, individually, and directly lowering a selected one of each said die blade and said perforating knife of said at least one transversely-spaced-apart pair of a die blade and a perforating knife; and (iv) a back-up plate to which said main block is secured; and (II) a second, lower, platen, said second, lower, platen being cooperable with said first upper, platen by relative movement therebetween to die cut cardboard sheets which are disposed therebetween;

whereby, when said first, upper, platen and said second, lower, platen are urged towards one another with said cardboard therebetween, said die blade and said perforating knife converge at a common focal point or starting point thereby providing a starting point for said openable and closable tab.

2. The apparatus of claim 1, further comprising a die blade block supporting a die blade, further comprising a die blade block bolt, and further comprising a die blade spring plate; further comprising a perforating knife block supporting a perforating knife, further comprising a perforating knife block bolt, and further comprising a perforating knife spring plate, wherein each said die blade block bolt is threadedly-secured within, and extends through, an associated die blade block, wherein each said die blade block is raised upon rotation of an associated die blade block bolt by reaction of an end of each associated die blade block bolt against said back-up plate, and lowered by reaction of said die blade spring plate and wherein each associated die blade spring plate is secured to an associated die blade by an associated indent which is punched out of an associated die blade, upon which an edge of an associated die blade spring plate rests; and wherein each said perforating knife block bolt is threadedly-secured within, and extends through, an associated perforating knife block, wherein each said perforating knife block is raised upon rotation of an associated perforating knife block bolt by reaction of an end of each associated perforating knife block bolt against said back-up plate and lowered by reaction of said perforating knife spring plate, and wherein each said perforating knife spring plate is secured to an associated perforating knife by an indent which is punched out of an associated perforating knife, upon which an edge of an associated perforating knife spring plate rests.

3. An apparatus as claimed in claim 1, said apparatus further comprising:

in said first platen, an anvil which is mounted in said base; separate securing means securing said anvil to said base; and manually-actuatable means for adjusting said separate securing means for selectively individually, positively and directly raising and lowering said anvil.

4. The apparatus of claim 3, further comprising a die blade block supporting each die blade, further comprising a die blade block bolt, and further comprising a die blade spring plate; further comprising a perforating knife block supporting each perforating knife, further comprising a perforating knife block bolt, and further comprising a perforating knife spring plate; and further comprising an anvil block supporting each anvil, further comprising an anvil block bolt, and further comprising an anvil spring plate;

wherein each die blade block bolt is threadedly-secured within, and extends through, an associated die blade block, wherein each die blade block is raised upon rotation of an associated die blade block bolt by reaction of an end of each associated die blade block bolt against said back-up plate, and lowered by reaction of said die blade spring plate, and wherein each die blade spring plate is secured to an associated die blade by an associated indent which is punched out of an associated die blade, upon which an edge of an associated die blade spring plate rests;

wherein each perforating knife block bolt is threadedly-secured within, and extends through, an associated said perforating knife block, wherein each perforating knife block is raised upon rotation of an associated perforating knife block bolt by reaction of an end of each associated perforating knife block bolt against said back-up plate and lowered by reaction of said die blade spring plate, and wherein each perforating knife spring plate is secured to an associated perforating knife by an indent which is punched out of an associated perforating knife, upon which an edge of an associated said perforating knife spring plate rests; and wherein each anvil block bolt is threadedly-secured within, and extends through, an associated anvil block, wherein each anvil block is raised upon rotation of an associated anvil block bolt by reaction of an end of each associated anvil block bolt against said back-up plate and lowered by reaction of said perforating knife spring plate, and wherein each anvil spring plate is secured to an associated anvil by an associated slot in an associated anvil, within which an edge of an associated anvil plate is disposed.

* * * * *